US008567098B2

(12) United States Patent
Hsu

(10) Patent No.: US 8,567,098 B2
(45) Date of Patent: Oct. 29, 2013

(54) ARTICLE OF FOOTWEAR WITH DETACHABLE UPPER AND LOWER DESIGNS

(71) Applicant: Henry Hsu, Torrance, CA (US)

(72) Inventor: Henry Hsu, Torrance, CA (US)

( * ) Notice: Subject to any disclaimer, the term of this patent is extended or adjusted under 35 U.S.C. 154(b) by 0 days.

(21) Appl. No.: 13/847,311

(22) Filed: Mar. 19, 2013

(65) Prior Publication Data

US 2013/0212908 A1 Aug. 22, 2013

(51) Int. Cl.
*A43B 3/24* (2006.01)
*A43B 3/26* (2006.01)

(52) U.S. Cl.
USPC ..... 36/101; 36/97; 36/100

(58) Field of Classification Search
USPC ..... 36/101, 97, 100, 58.5, 58.6, 7.5, 7.6, 36/135, 15, 50.1
See application file for complete search history.

(56) References Cited

U.S. PATENT DOCUMENTS

| | | | | |
|---|---|---|---|---|
| 2,193,943 | A * | 3/1940 | Shea | 36/11.5 |
| 2,438,711 | A | 3/1948 | Leach et al. | |
| 2,523,449 | A | 9/1950 | Rosenzweig | |
| 3,019,533 | A * | 2/1962 | Smith | 36/7.6 |
| 3,021,617 | A * | 2/1962 | Koch | 36/7.6 |
| 3,878,626 | A | 4/1975 | Isman | |
| 4,103,440 | A | 8/1978 | Lawrence | |
| 4,267,650 | A | 5/1981 | Bauer | |
| 4,300,294 | A * | 11/1981 | Riecken | 36/97 |
| 4,693,019 | A * | 9/1987 | Kim | 36/7.3 |
| 5,083,385 | A | 1/1992 | Halford | |
| 5,463,823 | A * | 11/1995 | Bell et al. | 36/11.5 |
| 6,349,486 | B1 | 2/2002 | Lin | |
| 6,453,578 | B1 | 9/2002 | Yung et al. | |
| 6,598,319 | B2 | 7/2003 | Hardt | |
| 7,591,084 | B2 | 9/2009 | Santa Ana | |
| 7,644,522 | B2 | 1/2010 | Ramirez | |
| 7,908,768 | B2 | 3/2011 | Cheskin et al. | |
| 8,230,621 | B2 | 7/2012 | Shmurak et al. | |
| 2005/0034325 | A1 | 2/2005 | Chen et al. | |
| 2005/0097781 | A1 | 5/2005 | Greene | |
| 2007/0113424 | A1 * | 5/2007 | Bell | 36/7.3 |
| 2008/0141562 | A1 | 6/2008 | Peveto | |
| 2008/0235992 | A1 | 10/2008 | Stefani | |
| 2010/0024251 | A1 | 2/2010 | Delgatty | |
| 2010/0325918 | A1 * | 12/2010 | Johnson | 36/102 |

* cited by examiner

*Primary Examiner* — Ted Kavanaugh
(74) *Attorney, Agent, or Firm* — Kenneth L. Green

(57) ABSTRACT

An article of footwear includes a sole and an upper attached to the sole. The sole includes a hard sole base forming an outline of the footwear and a mid sole resting on the sole base, the mid sole made of a softer material than the sole base to provide comfort to a wearer. The upper has sock like construction using stretchable materials to conform to shapes of the foot. The upper is attached to the sole by straps passing through the upper allowing a degree of independent motion of the upper to conform to a foot.

28 Claims, 14 Drawing Sheets

ARTICLE OF FOOTWEAR WITH DETACHABLE UPPER AND LOWER DESIGNS

BACKGROUND OF THE INVENTION

The invention relates to an article of footwear and in particular to a method for attachment and detachment of a footwear upper to a lower outsole.

Known footwear constructions methods, in particular leisure footwear, include two main components: 1) a formed outsole design with a generalized foot print shape to protect the bottom of a foot; and 2) an upper made with flexible material to cover, protect and secure the foot to the outsole. The outsole is typically made from a molded construction using urethane rubber and elastic polymers alike to serve as ground engaging surface for the footwear. The outsole can also provide cushioning, support while insulating the foot from impacts during a gait cycle. The outsole can be flexible and bendable but generally are not stretchable. The footwear upper is constructed out of layered materials such as leather, canvas, suede, fabric or combinations of natural and synthetic materials. These materials are utilized primarily for style while maintaining protection of the foot. Often the materials used are less flexible, breathable and can be hard and none pliable. In construction, the two main components are permanently bonded together in creating the footwear. A mid sole and sock liner are often used on top of the outsole to provide additional cushioning and support needs of the foot.

In a typical footwear construction, the footwear's shape or footprint is determined by the outsole design. In most instances general assumptions are made in creating an outline perimeter shape to accommodate all foot shapes. This shape also determines the fit of the fore foot and mid foot as the footwear upper is bound to the entire perimeters of the outsole. Since most footwear upper construction utilizes non-stretchable materials, lacing and/or elastic material is used to achieve proper fit in securing the footwear to the foot. The foot is first strapped in, then presses down into the sole as lacing is tightened to secure the foot. This method of adjustment no doubt creates uneven pressure points along the entire fore and mid foot region while in static or in motion. The conventional method of constructing footwear may lead to discomfort and fit issues due to the unique shapes and sizes of everyone's foot. A generalized footwear shape can fit differently on each wearer's foot having an equal overall shoe size. It can be difficult to create footwear to fit every foot shape the same way. The inflexibility of the footwear due to construction and use of materials can further attribute to the problem of fit and discomfort.

During a gait cycle, the biomechanical movements changes the external shapes of the foot as weight is being applied. This effects in particular, forefoot and mid foot region as it pronates to distribute body weight. In the push off stage of the gait cycle, the forefoot region bends in dorsiflexion and creates a folding compression tension onto the upper's forefoot areas. The binding compression effects are then transferred onto the top of the forefoot's toe area causing discomfort with each step. This binding effect is due to overly ridged upper material used on the upper and the bonding of upper to the perimeters of the outsole. The pronatory forefoot flexing movement can further compound the footwear discomfort level as the foot's natural motions are met with resistance within the footwear. This resistance also comes from the upper bound to the outsole's perimeter shapes restricting the forefoot's flexion and expansion movements.

Due to each wearer's unique foot shape, a better way of securing the upper to the lower is needed to address fit, comfort, and minimize pressure points to our feet.

Further, the upper's purpose is to cover and protect a wearer's foot. But more importantly in the eyes of the consumer, it is the style, color and design that matters most over the purchase decision. With the outsole bonded to the upper, the footwear is limited to just one style.

Numerous attempts have been made in the past to provide footwear having detachable upper construction, however, these detachable footwear systems reflect the typical footwear construction method described above, as the upper are still bound to the perimeter shape of the outsole. The prior inventions achieve detachability of the upper to the outsole by adding features where the upper and the outsole meets. The examples can be seen in US Patent Publication No. US2010/0024251A1 where loops are added along the upper's perimeter to capture the lower. Zipper systems are also used to combine the upper to the outsole in U.S. Pat. No. 4,103,440 and US Patent Publication No. 2008/0235992. Attachment elements are used in US Patent Publication No. 2005/0097781, U.S. Pat. Nos. 8,230,621B2 and 6,349,486B1 to secure the upper to the outsole. A complete upper footwear assembly with formed locking features along its mid sole perimeters to interlock with the outsole is shown in U.S. Pat. Nos. 5,083,385, 4,267,650, and 3,878,626. An outer sole with straps to stretch over the inner sole is described in U.S. Pat. No. 7,591,084. One of the earlier inventions pertaining to a detachable upper can be seen in U.S. Pat. No. 2,438,711A as the upper and lower are combined by lace looping through its perimeter base.

Thus, many novel ways of combining the upper to the lower outsole have been discloses. However, the prior art does not address the limiting effects on the foot's natural movements with an upper bound to the perimeter of the outsole shape. Furthermore, the prior art does not acknowledge a way of securing the footwear to the foot without causing uneven pressure points or binding as the foot moves through the biomechanical movements of a gait cycle.

In typical construction, the outsoles and mid soles more often are made flat, overly ridged and less flexible. The overall focus is on manufacturing process and style rather than comfort or function. The flat layers of mid soles and outsoles are easy to produce but offers inadequate cushion for many regions of the foot. These soles provides a flat cushioning bed on which the foot's contour will rest on. The inability for the sole to emulate foot's bottom contours hinders its natural biomechanical movement in a gait cycle. During a gait cycle the foot performs a trilateral movement known as pronation and supenation. Pronation is a compression state when weight is being transferred to the foot. Supenation is a rebound state for the foot to decompress and return to its natural state. Current production footwear outsole serves only as a stationary platform for the these movements and not as a system to enhance the movements of the foot. To require the outsole to flex and bend with the foot a thinner and more ergonomically designed outsole and mid-sole system is needed to hug the bottom contours of the foot.

The mid sole are typically made flat and of single density polyurethane foam such as Ethylene-Vinyl Acetate (EVA) and the like along the entire bottom sole surface. Such mid sole serves as the main cushioning and support mechanism for the footwear. While this is an economical and practical way of constructing a mid sole, it often overlooks the functional and longevity needs of a mid sole design. EVA foam deteriorates quickly with wear over time, with a designed life span lasting less than 6 months.

Different parts of the foot have unique cushioning and support needs driven by the bone structures and biomechanical motion of the foot. The rear of the foot, known as the heel, contains the Calcaneus bone structure which serves as the main load bearing base of the foot when in motion or at rest. The heel also provides the initial landing or strike during a gait cycle as part of our bi-pedal movement. As the heel strikes the ground, the heels may be subjected to the entire weight of our body. During running, jumping and other athletic sports activities, the heel strike may far exceeds one's own body weight. Thus a resilient, more energy absorbent and elastic material may be needed at the heel area.

The mid foot consists of a key-stone like structure with the Navicular, Cuboids, and Cuneiform bones. The mid foot also houses the Tarsometatarsal joint which serves as a connection to the first though fifth Metatarsal bones. The mid foot is also known as the medial and lateral arches of the foot. The mid foot joint structure serves as a compressible arch to allow flexibility. Flexing of the arch serves as a suspension system to absorb the load of the foot in compression and rebound. This trilateral motion is described as pronation and supenation during a gait cycle. Due to the biomechanical nature of mid foot, support is a much needed element to incorporate into the mid-sole's medial and lateral arch design.

The forefoot is located at the ends of the metatarsal bone as it connects to the phalanges also known as toes. At the joints of the phalanges and the first Metatarsal joint lies the Sesamoid bone. The Sesamoid bone with the ends of the first Metatarsal are also know as the ball of the foot. The ball of the foot serves as another load bearing zone as weight of the body is distributed onto the fore foot and the rear foot. The forefoot is also responsible for landing, weight distribution, and propulsion as the foot rolls forward to begin the pushing off the stage of the gait cycle. This unique fore foot zone may also require materials to be resilient, more energy absorbent and elastic that are unique from the needs of mid foot.

The outsole design in most footwear serves as one semi ridged flat platform to support the entire foot. In particular the rear heel area of the outsole is typically made flat with squared off edges different from the natural round shape of our heel. These edges or pads extend outward adding to the overall rear foot footprint area for balance, stability and weight distribution. This method of expanding heel support can be seen from the rear and the bottom of most sneakers and leisure footwear. While this design approach is warranted in some applications, not all footwear benefits from such a design. In some instances it may cause more injuries for the user. Injuries may result as the expanded heel support unknowingly lands or catches on an uneven or offset surfaces such as a steps or the sidewalk. By landing on an uneven surface, this causes the extended flat heel section to tilt as the foot tries to compensate and find its level. This translates into lost of balance or a quick twisting motion as our ankle is forced to move with the footwear. When twisting of the ankle joint exceeds the limitation of the ankle, flex injury may result in forms of a sprained ankle. A thinner and flexible rounded shape to closely mimic and surrounds our heel contours may be needed for the outsole design. This type of outsole design will allow the forefoot and mid foot to move and flex as it adapts to the uneven surface. The external round heel section allows the heel to slide down from the uneven surface rather then forcing the entire foot and ankle to twist as whole.

Current indoor footwear market consists mainly of foam padded slippers, moccasins, and loafers. Known padded slippers generally utilize low density foam for cushioning and padding. The foam used is often of low density and offers only short term general cushioning as it loses its deflection and rebound quickly. The slipper are made to loosely fit the foot as they are made oversized to accommodate many different foot shapes. This causes the user to constantly maneuver one's foot in trying to keep their slippers on their feet while sitting or walking. Indoor footwear often does not provide contours formed into the soles to properly support and cushion the foot. The padded slippers, moccasins and loafers can be overly insulated without proper ventilation causing overheating and foot sweat. While some indoor footwear are made to be washable, they are difficult to dry due to the thick foam padding bound to the rubber outsole. Sanitary odor of these footwear may also be of concern.

Socks are often a preferred choice for indoor use due to the light and comfortable natures of its construction, as they are easy to wash and dried. Some socks are marketed for indoor use by adding molded rubber textures on the sole for traction against smooth slippery floor surfaces. Socks are comfortable to wear as they generally do not have pressure points exerted onto the foot. The stretchable body of the socks easily conforms to the wearer's unique foot shapes and stay on the foot without adjustment. The light and breathable nature of the materials offer just enough protection and insulation for indoors use, while offering a variety of styles and designs to suit the taste of the wearer. However, known socks provide almost no cushioning and support for the foot. The foot can still be subjected to shocks and impacts forces from walking on hard ground surfaces. Wear and tear is also major issue for socks as woven material being subject to high pressure and friction. The wear is compounded when used over more abrasive floor surfaces like concrete, tile and wood. Typically the life cycle of an indoor sock can be short as the heel and forefoot wears at a quicker pace. Although inexpensive to produce and purchase, overtime the cost may compound.

SUMMARY OF THE INVENTION

The present invention addresses the above and other needs by providing a footwear system having an upper and a sole designed with the ability to be attached and detached from each other. The upper and the sole combine as a system to achieve comfort, cushioning, fit, style, and support needs of the wearer. When in use, the footwear uniformly distributes pressure on the entire foot without applying unequal pressure points as feet flex and expands in a gait cycle. The upper preferably slips on covering the entire surface of the foot using expandable materials much like a common sock. The sole can be formed with contours to conform to the shape of the foot in an unloaded state to serve as a low profile projected extension of the wearer's sole shapes. The footwear thus provides the feel and comfort of a sock with a flexible ergonomically supportive sole.

In accordance with one aspect of the invention, the sole may include straps along its perimeters with attaching features able to secure the upper onto the sole. Using the straps to attach the upper to the sole does not hinder the upper's ability to provide evenly distributed pressure and conformance to the foot for a flexible and adjustable customized fit accommodating different perimeter shapes of the wearer's foot. The straps may loop through the corresponding slots or mouths along the upper's perimeter then secure back onto the sole while allowing the upper to stretch and expand with the foot freely and independent of the sole, without binding and preserves the sock like property of conforming to the wearer's complete foot shape without limitations set fourth by the straps or by bonding the upper to the sole perimeters. Using the straps to attach the upper to the sole ensures an even distribution of the footwear's weight across the entire foot surface without causing uneven pressure. The straps used to attach the upper to the sole thus achieve comfort, fit, support, and cushioning for the foot by removing restrictions of movement, binding, and pressure points present in conventional footwear.

In accordance with another aspect of the invention, there is provided a detachable upper and sole design which further provides many stylistic and practical options for the footwear because the upper is an interchangeable component. With the upper able to separate from the sole, cleaning and ease of washing provides additional benefit for the footwear.

In accordance with yet another aspect of the invention, there is provided an upper having a sock like construction to incase the whole foot. A cut and sewed design or combinations of, may also be used in the upper construction. The upper may also be constructed out of a wide range of woven or non-woven materials with different thickness, stretch ability, and pliability to achieve specific application needs. A combination of different materials and cut patterns may be used to enhance fit, comfort, durability, breathability and style in construction of the upper.

In accordance with yet another aspect of the invention, there is provided a method for attaching the upper to the sole which lies in the ability of the straps to loop through mouths in the uppers in multiple areas, with opposite ends of the straps attached to the sole to hold the upper in place on the sole. There are several ways for the straps to enter and exit the upper. In the one embodiment of the present invention, slots are placed along the perimeter of the upper to allow straps to enter and exit the upper. This method of placing straps along the outer perimeter edge in capturing the upper allows the top and bottom portions of the upper to stretch and expand with the foot freely and independently without binding. It preserves the upper's ability of conforming to the wearer's complete foot shape without limitations set fourth by the straps or bonding to the sole.

In accordance with another aspect of the invention, there are provided locations of slots (or mouths) corresponds to the straps entry and exit locations into and out of the upper. Single slots can also be uses to capture and conceal the base of more than one strap. The slots opening may be reinforced by stitching or piping to strengthen the opening against tearing and over stretching. Such reinforcement stitching connecting the top and bottom ends of adjacent slots can provide dimensional and location stability with each other.

In accordance with another aspect of the invention, there are provided straps entering and exiting through a single layer upper, and in direct contact with the wearer's foot. A secondary layer of material may be provided to insulate the foot from the straps. The method of insulation can also create a channel like path of travel for the straps by attaching the secondary layer material to the upper along the top and bottom boundary of the straps. The attachment methods can be of chemical or mechanical means along the path of the straps while keeping the straps entrance and exit locations open. The upper may be constructed out of multi panel and layered material which may hide the slots openings behind its layered materials. This type of construction allows the straps to dive under and/or pass through the layers seamlessly. Multi panel and layered material may also be attached to the upper in creating path of travel for the straps instead of using slots on the primary full upper layer.

In accordance with yet another aspect of the invention, there are provided multiple methods of constructing and arranging the secondary layer with the primary layer of the upper in insulating and capturing the straps. Each of these methods can provide unique functional and esthetic benefits for the wearer. Ease of manufacturing are also benefits to consider. The multiple methods are results of using a full upper layer to cover the entire foot while a secondary layer can be attached on the outside or inside of the said full upper layer. The secondary layer can be made to cover the entire foot or just portions to cover the straps. It can also only cover the top or bottom portion of the foot. The option of covering the top of the foot creates a double top layered upper to better protect the foot while a single layer at the bottom sole creates better cooling. The option of covering the bottom of the foot creates a double bottom sole layered upper to better cushion the foot of the wearer with a single light upper layer design. Variations of material used in the two layers can also attribute to fit, support, insulation, cushioning and comfort of the footwear.

In accordance with another aspect of the invention, there are provided primary and secondary uppers which may be made with various lengths extending up beyond the ankle and onto legs of the wearer. Longer portions of the upper may serve as esthetic and/or insulation needs for the wearer with a boot like appearance. The extended height can be fold back down onto the upper exposing the inner sides of the upper material and pattern to serve as an esthetic motif. The opening of the extended upper can be enlarged, made with a reinforced brim to be attached back onto itself above and below the perimeter edge of the straps with stitching. The extended top portions are folded down onto itself in creating sleeves to capture the straps. This method can effectively create a sleeve like path of travel for the straps by using one piece upper construction.

In accordance with still another aspect of the invention, there are provided uppers which may be constructed with reinforced portions to serve as contact or pulling points for the wearer to slip on the footwear. The reinforced pulling points can be made as fortified elastic strips extending form the slots opening up to a rim of the upper. The pulling strips on the upper can be placed at multiple locations on the upper to provide the wearer with optimal ingress of footwear.

In accordance with another aspect of the invention, there are provided buttons which may be used on the upper as another method of securing the upper to the sole. Placed on the reinforcement stitch of the upper, the button's locations can be kept dimensionally stable with respect to the slots opening. This allows the upper to properly index with the sole in respect to the slots and straps entry and exit locations. In one embodiment of the present invention, upper buttons are used to secure the sole's arch wings to the upper's corresponding mid foot region. As an alternative method of attachment, snap-fit buttons can also be used in place of standard buttons.

In accordance with another aspect of the invention, there is provided a separate mid sole which may be added onto the sole in providing deeper contours with cushioning and support needs of the wearer's foot. The mid sole can be made with lower density material compared to the sole by forming it with a resilient single or multiple density foam. The top surface support of the mid sole contacting the wearer's foot can be formed with natural contours of the sole in providing better fit and support. The contours can have a concave heel cup region transitioning forward into an arched up mid foot region then spreading out into a shallow concaved forefoot region.

In accordance with another aspect of the invention, there are provided a top surface of the mid sole which may also have a surface of a second elevation in forming grooves to allow the flexion of the foot. Longitudinal medial and lateral grooves may aid in the mid foot arches flexion while the lateral forefoot grooves enable the forefoot flexion in dorsiflexion. The grooves can also serve as channels of ventilation for the bottom sole, and provide an active ventilation system.

In accordance with another aspect of the invention, there is provided unique cushioning and support for different regions of the foot based on the bone structures and biomechanical motion of the foot. The major load bearing zone described above may require localized cushioning and support unique to the rest of the foot. To offer cushioning zones with different density and resiliency, cavities may be strategically molded in places throughout the mid sole. The location of the cavities may include the heel, arch and forefoot zones. Individual inserts of different contours, density, and durameter may be inserted into the cavities to provide targeted cushioning support needed for the load bearing zones of the foot. Combinations of the inserts can be used by connecting load bearing zones to maximize cushioning area while simplify the manufacturing process. Various density, colors, texture and durameter inserts may also be used in the cavities to suit the needs of the user. Inserts may be formed in place by dual shot multi cavity molds or produced in separate mold to be assembled in post production. The insert durameter can vary between the forefoot region to the heel region over a Shore hardness range of 10 A to 50 A depending upon wearer's weight and support needs.

In accordance with another aspect of the invention, the inserts which may also be used to express difference in color, texture, design and style for the footwear. In one embodiment, cutouts are molded on the sole design to let the insert protrude through, therefore making it visible from the bottom of the sole. The insert can also be used as a method of displaying branding logos and product line. Open cell mid sole insert may also be used to provide an active ventilation system to the bottom sole. Extending the inserts through the sole increases the compressible height of the insert, therefore adding to the resiliency for the load bearing zones. Due to the exposed heel and forefoot zones, traction within those zone may be increased as softer and more resilient inserts material provides better traction an adhesion on flat walking surfaces when compressed. However, mid sole design without inserts or insert cavity may also benefit from having localized load bearing zones extended down through the sole's formed cavities by optimizing compressible height of cushioning.

In accordance with still another aspect of the invention, there are provided a sole design which may reflect the natural contours and curvature of the foot sole's shape. Following the contours of the foot allows the sole to have a more consistent thickness in providing a closer and more direct contact feel to the ground surface. The even thickness allows the sole to flex freely and evenly without obstruction from thick ridged regions. The natural foot contours may include a mild convex curvature at the fore foot transitioning into a raised arch area of the mid foot as It flows rearward into the rounded rear heel cup shape to wrap around and up onto the back of the heel. The heel can be cradled and fully supported in a rounded heel cup shape formed into the sole. The contours can also deviate away from the mid foot to the rear foot region in creating a thicker cushioning zone for the foot. Better support can also be gained by having a slightly elevated rear foot region as with conventional footwear design.

In accordance with another aspect of the invention, there are provided surfaces of a second elevation formed into the bottom of the sole creating grooves to enable flexion of the foot. Longitudinal medial and lateral grooves can follow the same flexion path as the mid sole grooves. Lateral forefoot grooves can also follow the same flexion path as the mid sole forefoot grooves. This ensures the assembled sole system flex in unison with the same hinge position strategically placed for the forefoot and mid foot flexion.

In accordance with still another aspect of the invention, there are provided holes formed along the bottom of the sole corresponding to the major load bearing zone described above in the mid sole, allows the inserts or mid sole's localized zones to protrude through the bottom sole. The portion of inserts or mid sole can be exposed and visible from the bottom of the footwear. The exposed portion can be formed as colored graphic logos contrasting against the sole's material, color and textures thus displaying as a trim level and brand identity element of the footwear.

In accordance with another aspect of the invention, there is provided an sole having a raised toe tip area to protect the fore foot toes. This feature extends forward from the fore foot sole area, then wrapping upwards in front of the toe area. The sole may also have a raised heel area that extends from the rounded heel area up over the Calcaneus ending at the base of the Achilles tendon. The mid foot region may also have a raised area extending out from the bottom sole up towards the medial and lateral arch portion of the foot. The arch wing like flaps hug the contours of the mid foot. A molded in slit atop of each arch wing allows buttons to penetrate from the upper. The buttons are used to secures the sole's arch wings to the medial and lateral sides to the upper.

In accordance with another aspect of the invention, there are provided multiple straps to secure the upper to the sole. Front straps may be placed on both sides of the raised toe tip area of the sole extending rearward towards the mid foot region on both medial and lateral sides. The rear straps may be placed from both sides of the raised heel area on the sole extending forward on both medial and lateral sides. Straps then terminate midway within each corresponding side of the lateral and medial arch wings. Straps then terminate midway within each corresponding side of the lateral and medial arch wings. The straps may be fitted with multiple through holes in succession with equal center distance to correspond to the studs formed onto the arch wings with the same center distance apart. The through holes formed in the straps can have a wider opening that tapers to an smaller center opening. This allows the heads of the arch wing's studs to be guided through the insertion process. The slightly larger head are pressure fit through the strap holes in trapping the studs to the straps. This creates a system of interlocking the front straps back onto the mid foot portions of the sole. Extra holes allow for adjustable length on the straps as it can attach onto the arch wing studs at different intervals to accommodate a wide range of foot shapes. The sole front straps are now able to loop through the corresponding slits on the footwear upper, then lock back in place onto itself, thus combining both parts as one.

In accordance with yet another aspect of the invention, there are provided straps having a concave inner section along the length of the straps to follow the curvature of the forefoot as it surrounds the perimeter of the forefoot. The straps can be formed with the same pliable and resilient material as the sole, therefore it may bend to conform to the fore foot shapes of the wearer. The straps can also aid the positioning of the foot with the sole while offering a level of protection for the toes from accidentally striking objects or furniture.

In accordance with another aspect of the invention, there is provided an sole made from single or multiple piece construction. A single formed piece may contain dual or triple shot molding techniques to achieve different density, color, texture and durameter fused into one main part. This molding technique utilizes one tool assembly with multiple cavities to engage in stages in forming different components onto one main part. The mid sole and/or inserts may be formed with unique materials chemically or physically bonded together in the molding process so no glue or post production assembly is required.

In accordance with still another aspect of the invention, there is provided an sole constructed from multiple layered of sheet materials. A wide range of natural or synthetic materials can be used as the layers are first cut, then attached together in forming an sole layer. The cut perimeter shapes of the sole resembles a flattened version of the preferred embodiment sole design. It may contain front and rear straps with the mid foot medial and lateral arch wings. The method of attachment for the straps and arch wings can be substituted by snap-fit buttons organized in the same linear succession for adjustability.

In accordance with still another aspect of the invention, there is provided a formed mid sole providing cushioning, support and ground engaging surfaces for the sole. The mid sole may be sandwiched within the sole layers and formed with surface of second elevation to protrude through the bottom outer layers cut openings to engage the ground plane. This type of sole construction is typically referred to as a driving design. The top surfaces of the mid sole may also be formed with natural contours of the foot in providing support. Inserts may be incorporated into the mid sole design in the load bearing zones of the foot to provide improved resilient cushioning for the wearer.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
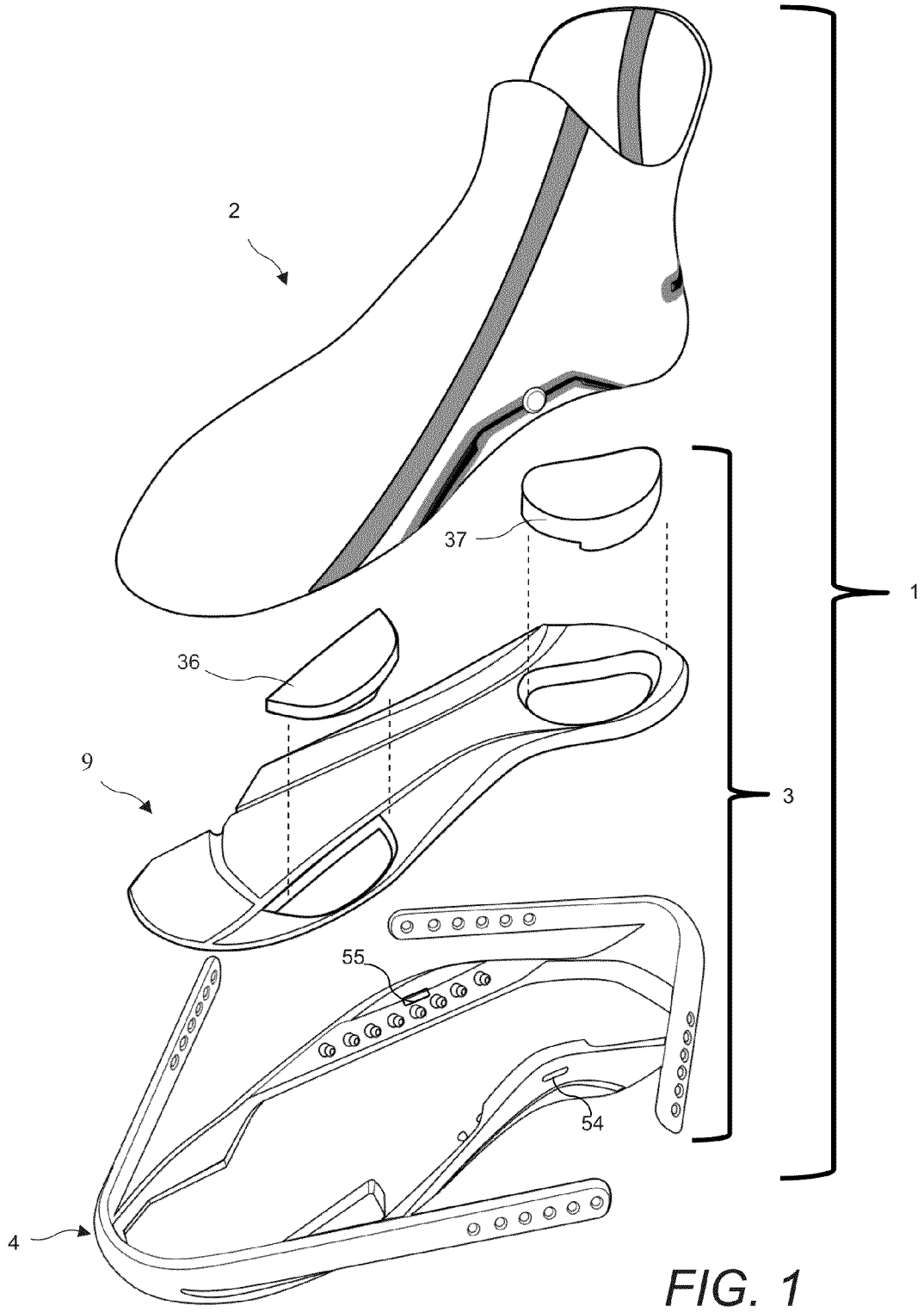
FIG. 1 is an exploded, elevated front three quarter view of an article of footwear and detachable upper and lower sole design with all its components according to the present invention.

An article of footwear 1 including a detachable upper 2 and sole assembly 3 according to the present invention is shown in FIG. 1 in an elevated front three quarter exploded view showing major components. The upper 2 covers a wearer's foot and the sole assembly 3 supports the wearer's foot. The sole assembly 3 includes a sole base 4 and mid sole 9 with an individual forefoot inset 36, and heel inset 37. A forefoot insert 36 is located mainly in the forefoot zone and a heel insert 37 is located in the heel zone to provide the foot with proper localized cushioning and support. The sole base 4 serves as a ground engaging surface and a carrier for the mid sole 9. The mid sole 9, with or without inserts 36 and 37, may also be molded in place to the sole base 4 with multi cavity dual-shot injection molding process tools. Depending upon the performance demand of the footwear, different density and durameter foam and/or gel may be used for the mid sole 9 and the inserts 36 and 37.

Figure 2:
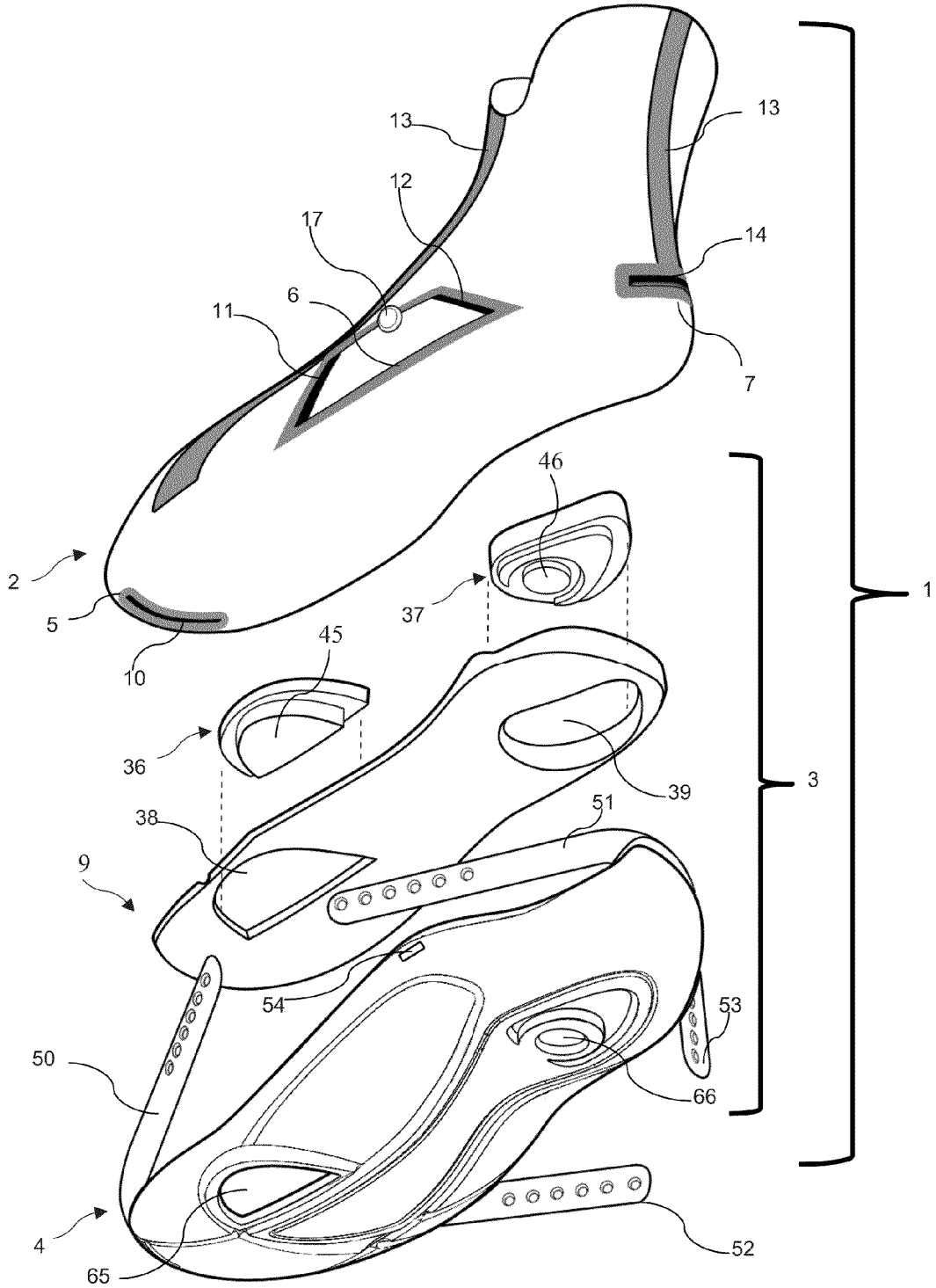
FIG. 2 is an exploded, bottom rear three quarter view of an article of footwear and detachable upper and lower design with all its components according to the present invention.
Figure 3:
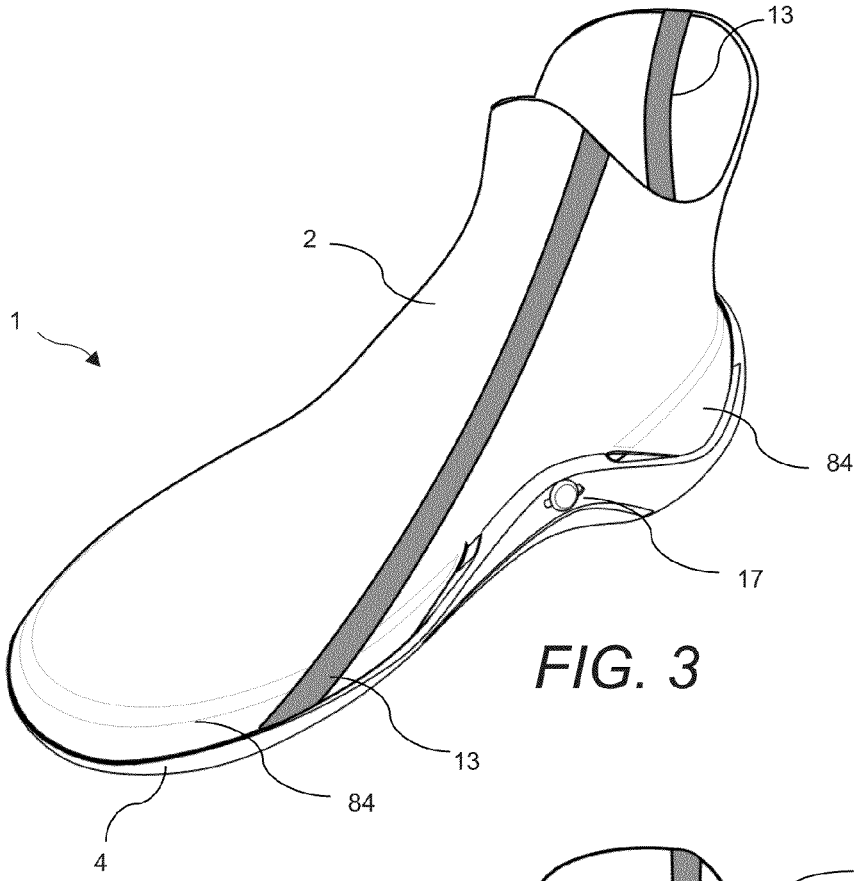
FIG. 3 shows the assembled front three quarter view according to the present invention.
Figure 4:
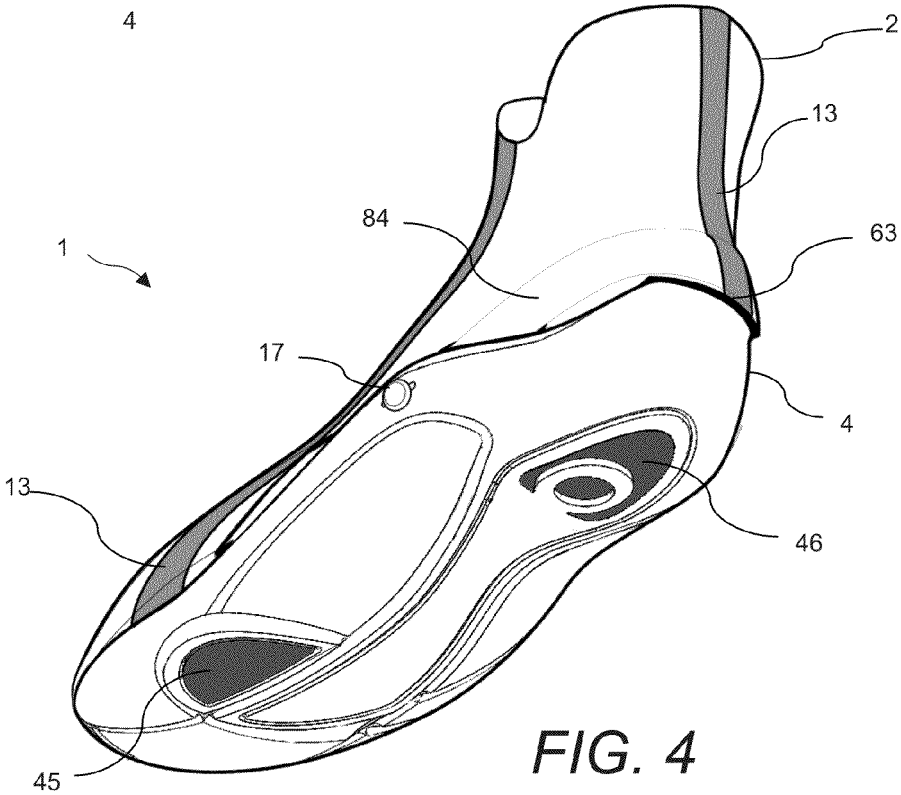
FIG. 4 shows the assembled bottom rear three quarter view according to the present invention.

FIG. 2 shows a bottom, rear three quarter view of the footwear 1 and its components, and illustrates the sequence of assembly for the sole assembly 3 as the inserts 36 and 37 are placed in the cavities 38 and 39 of the mid sole 9. FIG. 3 shows the complete assembled footwear 1 in an elevated, front three quarter view, and FIG. 4 shows the bottom, rear three quarter view of the complete assembled footwear 1. Passages 65 and 66 through the sole base 4 allow insert bases 45 and 46 of the inserts 36 and 37 (see FIG. 2) to protrude and show through the sole base 4.

Figure 5:
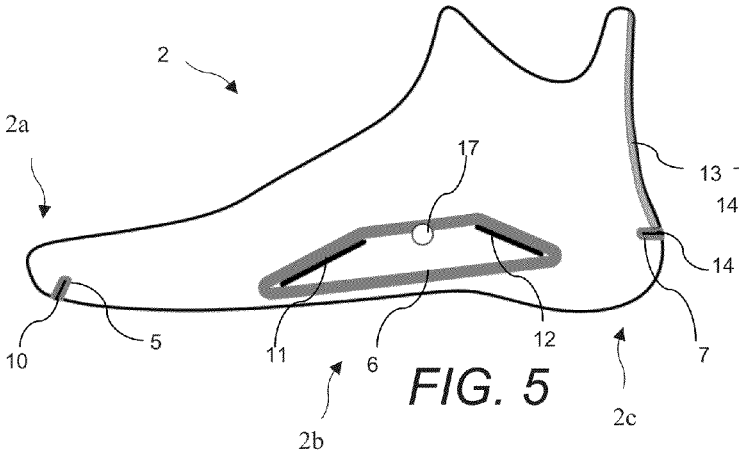
FIG. 5 is the medial side of footwear upper design with location slots layout indicated according to the present invention.
Figure 6:
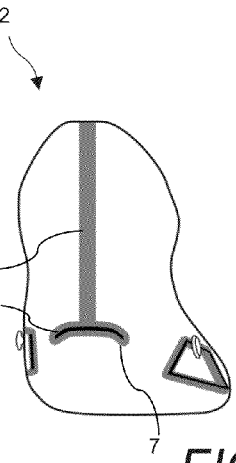
FIG. 6 is the rear view of footwear upper design with location slots layout indicated according to the present invention.

FIGS. 5-8. show detailed views of the upper 2. FIG. 5 is a medial side view of the upper 2 with slots 11 and 12 in mid foot region 2*b*. The slots 11 and 12 are surrounded and connected on both ends by reinforced stitching 6 to keep them dimensionally stable with each other while preventing tears. An attachment, for example a medial side button 17, attached to the upper 2 is located near center on the top portions of reinforcement stitch 6. The button 17 is used to attach through the formed in slot 54 (see FIGS. 1, 2, and 30) on the medial arch wing 60 (see FIG. 28) of the sole assembly 3, thus connecting the sole base 4 to the upper 2. FIG. 6 is a rear view of the upper 2 showing a heel slot 14 in the heel region 2*c* of the upper 2 surrounded by reinforced stitching 7. The reinforced stitching 7 keeps the slot 14 dimensionally stable while protecting against tears. A reinforced strip 13 runs vertically from the reinforced stitching 7 of slot 14 to the top of the upper 2. The reinforced strip 13 provides the wearer a rearward location to pull up the footwear 1 using the reinforced strip 13 tied to the upper's structure so the pulling forces can be transferred and connected to the sole assembly 3 when pulling on the footwear 1.

Figure 7:
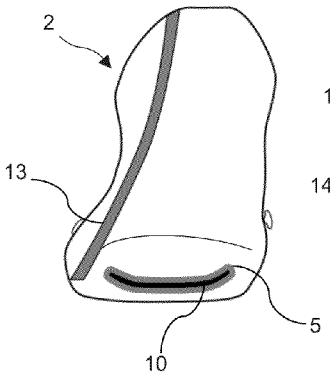
FIG. 7 is the front view of footwear upper design with location slots layout indicated according to the present invention.
Figure 8:
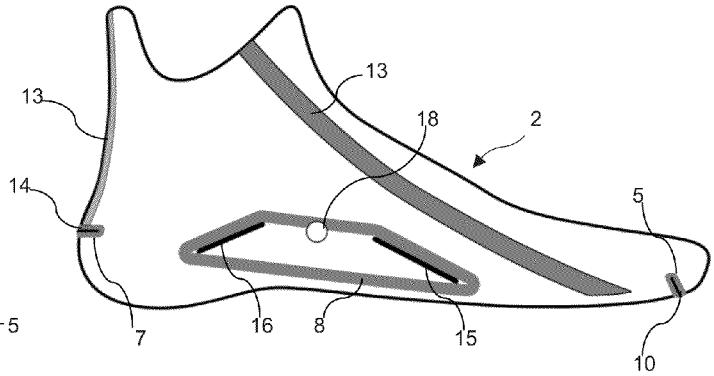
FIG. 8 is the lateral side view of footwear upper design with location slots layout indicated according to the present invention.

FIG. 7 is a front view of the upper 2 showing the toe slot 10 in the toe region 2*a* of the upper 2 surrounded by reinforced toe stitching 5. The stitching 5 keeps the slot 10 opening dimensionally stable while protecting it against tears. A second reinforced strip 13 connected to the toe region runs up to the top of the upper 2 can be used as a frontal pulling location when slipping on the footwear 1. FIG. 8 is a lateral side view of the upper 2 with slots 15 and 16 in the mid foot region. The slots 15 and 16 are surrounded and connected on both ends by reinforced stitching 8 to keep the slots 15 and 16 dimensionally stable with each other while preventing tears. A lateral side button 18 is attached to the upper 2 and located near center on the top portions of stitching 8. The button 18 is used to attach through the formed in slot 55 (see FIGS. 28 and 30) on the lateral arch wing 61 of the sole assembly 3, thus connecting the sole base 4 to the upper 2. Depending upon the performance needs of the upper 2, the upper 2 may be constructed out of single or multiple layered material.

Figure 9:
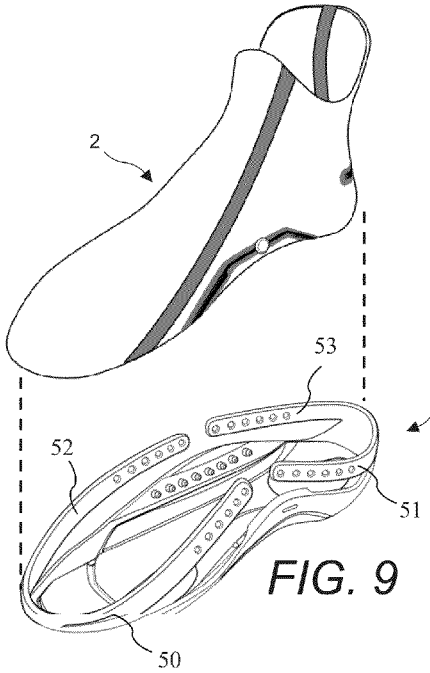
FIG. 9 shows a pre-assembled view of the footwear upper with the lower according to the present invention.
Figure 10A:
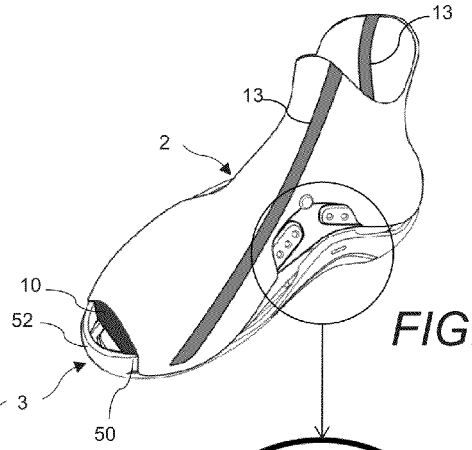
FIG. 10A shows the first assembly step to unite the upper with the lower as straps enter and exit through the upper according to the present invention.
Figure 10B:
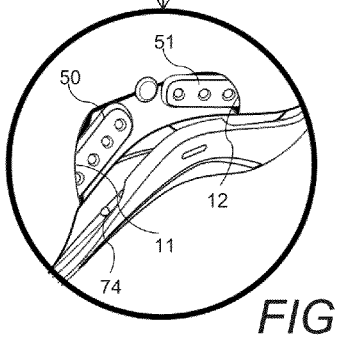
FIG. 10B is the magnified mid foot region showing straps exiting through the upper as they are ready to be attached to corresponding arch wing attachment studs according to the present invention.

FIG. 9 illustrates a pre assembled state of the upper 2 ready to be attach to the sole assembly 3 and the straps 50-53 ready to enter the upper 2. FIG. 10A shows the sole base 4 medial side front strap 50 entered into the toe slot 10 and exits out through the medial side slot 11, while the lateral side front strap 52 also entered through the front toe slot 10 and exits out through the lateral side slot 15. The slot 10 may now be pulled down over and covering the front raised toe area 56 (see FIG. 28). This method effectively hides the complete frontal base of the straps and serves as a forefoot anchoring point for the upper 2 in stretching out longitudinally, ready to receive wearer's foot. Although hidden by the drawing, the sole's lateral rear strap 53 entered into the upper's rear slot 14 and exits out of slot 16. The medial rear strap 51 enters into the upper's rear slot 14 and exits out of slot 12 in the same way. The heel slot 14 can be pulled down over the rear raised heel area 62 allowing the upper 2 to cover the rear raised heel area 62. This method effectively hides the rear base of the straps and serves as a rear foot anchoring point for the upper 2 in stretching out longitudinally, ready to receive wearer's foot. FIG. 10B is a detailed view of the straps 50 and 51 exiting through the corresponding slots 11 and 12 in position to be attached to the medial arch wing. Front straps 50 and 52 enter the upper 2 through the single toe slot 10 and exit the upper 2 through the slots 11 and 15 of the upper 2.

Figure 11A:
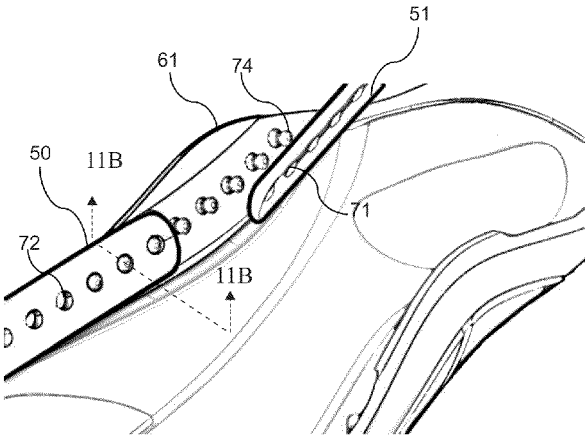
FIG. 11A shows the strap's through holes being attached to corresponding arch wing studs according to the present invention.
Figure 11B:
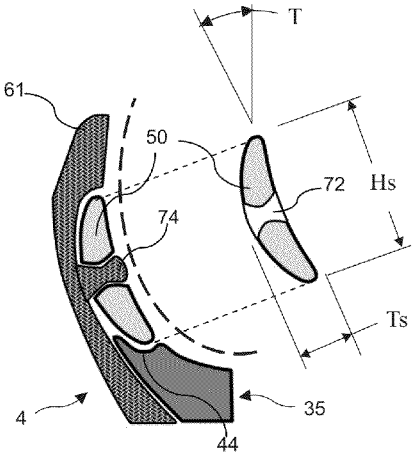
FIG. 11B shows the cross-sections of strap's through hole before and after attachment to corresponding arch wing studs according to the present invention.

FIG. 11A is an interior view showing the medial side strap through hole 72 ready to engage the corresponding studs 74 on the medial arch wing 61. FIG. 11B shows a cross section of the strap 50 with its through hole 72 before and after being attached to the studs 74 of the arch wing 61. The through holes 72 are made with a tapered center section for locking onto the studs. The through holes 72 formed in the straps 50 can have a wider opening that tapers to a smaller center opening. This allows the heads of the arch wing's studs 74 to be guided through the insertion process. The slightly larger head is a press fit through the strap holes 72 in capturing the studs 74 in the strap 50. This creates a system of interlocking the front straps back onto the mid foot portions of the sole assembly 3. It also illustrates how the cross section of the strap 50 embedded into the arch wing 60's concave depression to creates a flush inner surface to hug the mid foot contours of the wearer's foot. A partial section of the medial arch side slot 44 of the mid sole 9 is also shown to provide a pocketed area to receive the bottom portions of the straps 50, thus continuing the smooth inner transitional surfaces onto the mid sole. Forming flush inner surfaces insulates the wearer's foot from any discomfort caused by uneven surfaces and as much as 27 degrees differences in material hardness.

The straps have a height Hs and a thickness Ts and reside nearly vertically. The height Hs is preferably between five and 40 mm and the thickness Ts is preferably between two and fifteen mm, having slightly concave inner surface and slightly convex outer surface, and the top of the strap may have a tilt T away from the foot at the top of the strap. The tile T may be nearly zero and the toe and heel, and as much as 27 degree near the arch wings 60, 61.

Figure 12A:
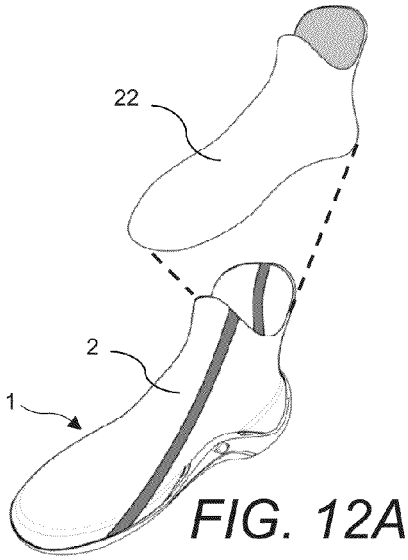
FIG. 12A shows inserting a secondary layer as full liner to insulate the foot against the straps by using double layered upper construction according to the present invention.

FIG. 12A shows an assembled footwear 1 including a full inner liner 22, ready to be inserted into the upper 2. There are multiple methods of constructing and arranging a secondary layer with a primary layer of the upper 2 in insulating and capturing the straps 50-53. Each of these methods can provide unique functional and esthetic benefits for the wearer. Ease of manufacturing are also benefits to consider. The upper 2 with slots described above in FIG. 5-8 can be combined with the full inner liner 22 to insulate the wearer's foot from the straps now looped through the upper 2.

Figure 12B:
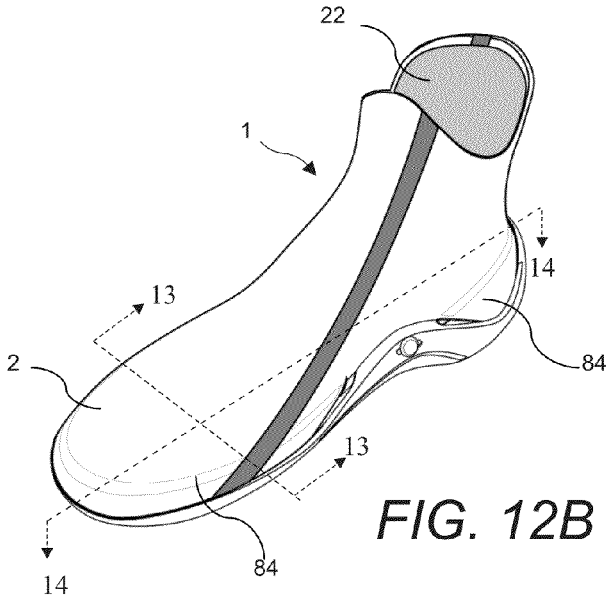
FIG. 12B shows the assembled front three quarter view of the double layered construction with cross-section plane indicated according to the present invention.
Figure 13:
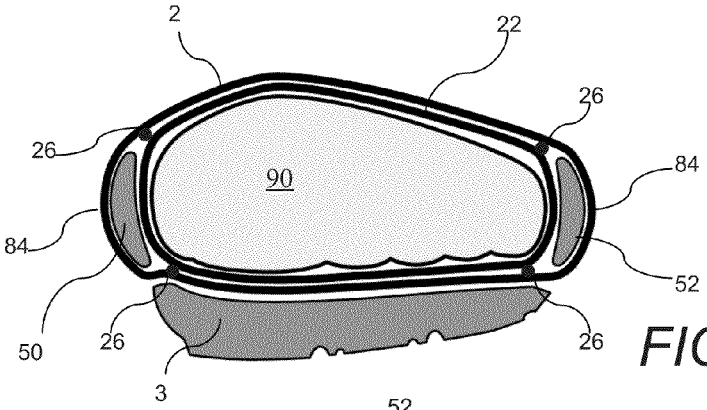
FIG. 13 shows the assembled front, cross-section view through the forefoot region with straps captured between the double layered upper according to the present invention.

FIG. 12B shows an assembled footwear 1 having the full inner liner 22. FIG. 13 shows a cross-sectional view of the footwear 1 taken along line 13-13 of FIG. 12B. The foot 90 is surrounded by the full inner liner 22 to insulate the foot 90 from the straps 50 and 52, as the upper 2 covers over them. This construction method creates a double layered upper to cover the entire surface of the foot 90. The upper 2 may be an insulating type sock used for cooler climates, while the double bottom sole layers can provide additional cushioning. Stitching 26 combining the two layers along both top and bottom edge of the straps in creating a channel for the straps is also shown. The straps 50 and 52 are shown as suspended side walls to keep the foot 90 in position with the sole 3. While not connected to the sole assembly 3 in the forefoot section shown, the straps and the double layered upper are free to move laterally with the wearer's foot in expansion and contraction. Therefore the foot 90, the upper 2, and the straps can flex and move freely and independently from the sole 3, preserving the upper's natural ability to conform and evenly distribute pressure throughout the wearer's foot. The cross-sectional shape of the straps 50 and 52 can be seen as providing concave inner walls surface to better conform with perimeter shapes of the foot 90. The outer walls of the straps 50 and 52 are shown with a convex shape in creating a smooth bumped out curvature shape 84 on the exterior of upper 2. Variations of material used in the upper layers can also attribute to fit, support, insulation, cushioning and comfort of the footwear.

Figure 14:
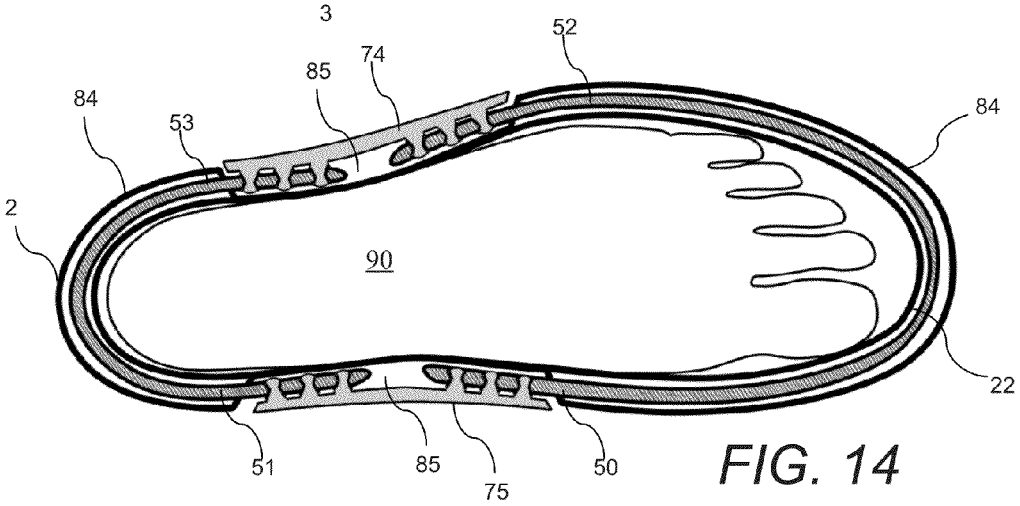
FIG. 14 shows the assembled top, horizontal cross-section view through the foot with straps diving in and out of the double layered upper according to the present invention according to the present invention.

FIG. 14 is a cross-sectional view taken along line 14-14 of FIG. 12B showing the straps 50-53 captured between the upper 2 and inner liner 22 creating a raised area 84 around the perimeters of upper 2. It also shows the exit locations of the straps 50-53 through corresponding slots 11 and 12 and 15 and 16. The exposed portions of the straps 50-53 are shown in the mid foot region, attaching to the studs 74 and 75 from the arch wings 60 and 61. The forefoot straps are made with flexible and pliable material allowing it to bend and flex in conforming to the wearer's unique foot shapes. As an attachment method for the upper 2, the forefoot straps 50 and 52 also serve as protective walls for the toes and the forefoot region of the foot. The flexible forefoot straps with the raised toe area 56 (see FIG. 28) surrounds the perimeters of forefoot offering a degree of protection against accidental striking of objects or furniture. Combining the upper 2 with the sole base 4 in this way allows the forefoot to move, flex, and expand more independently without predetermined boundaries set by the sole when uppers are permanently bound to the sole.

Figure 15A:
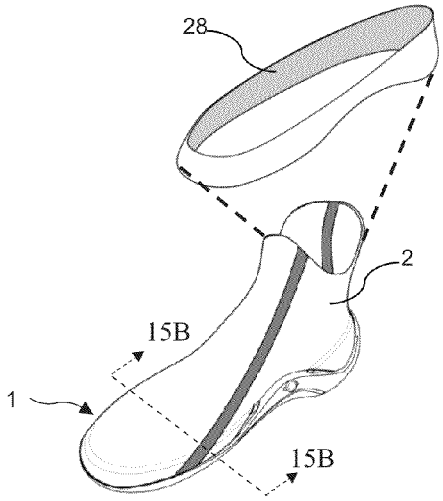
FIG. 15A shows inserting a localized liner layer to insulate the foot against the straps by using a single upper construction.
Figure 15B:
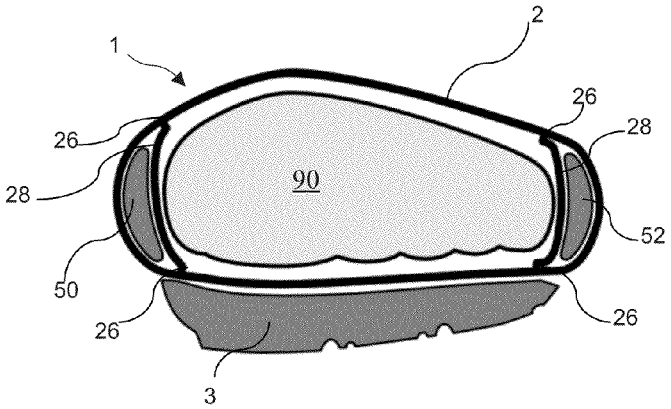
FIG. 15B shows a cross-sectional view of the assembled front, cross-section view through the forefoot region with straps captured between a localized liner layer attached to the upper layer taken along line 15B-15B of FIG. 15A, according to the present invention.

FIG. 15A shows an assembled footwear 1 including a localized inner strap liner 28, ready to be inserted into the upper 2. The strap liner 28 is constructed as a ring of material, without a bottom surface, to insulate the foot from the straps. The upper 2 with slots described in FIG. 5-8 can be combined with a inner straps liner 28 to insulate the wearer's foot from the straps now looped through the upper 2. FIG. 15B shows a cross-sectional view taken along line 15B-15B of FIG. 15A showing an assembled forefoot section of footwear 1 having inner straps liner 28 covering only the straps 50 and 52. The liner is attached by stitching 26 combining the two layers along both top and bottom edge of the straps in creating a sleeve like path of travel for the straps. This method of using a continues loop of stretchable material as inner liner 28 preserves the upper 2 with a single layered construction. It can be used as a thinner and lighter type upper design with minimal insulation used in warmer climates.

Figure 16A:
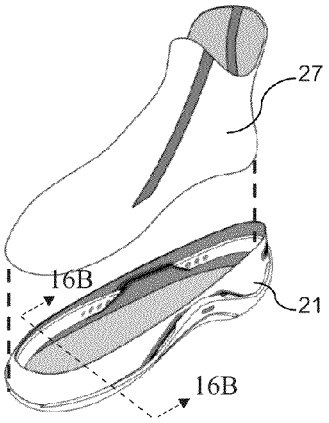
FIG. 16A shows an alternative method of attaching external half liners with slots attaching to the full upper without slots according to the present invention.
Figure 16B:
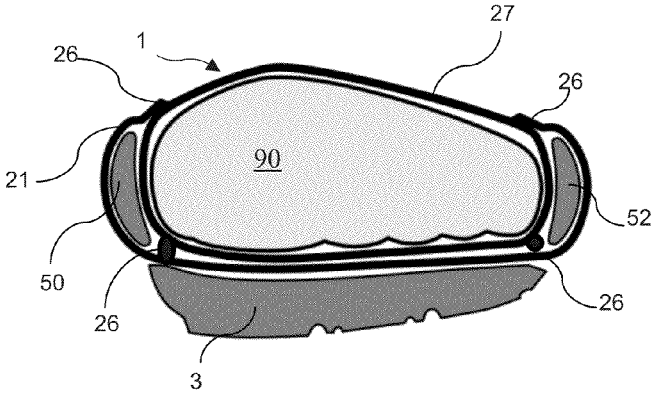
FIG. 16B shows a cross-sectional view of the assembled front, cross-section view through the forefoot region with straps captured between external half liners layer attached to the upper layer without slots taken along line 16B-16B of FIG. 16A, according to the present invention.

FIG. 16A shows the upper using a full liner 27 attaching to an external half upper 21 having same slots locations as the upper 2 described above in FIG. 5-8, and FIG. 16B shows a cross-sectional view of an assembled forefoot section of footwear 1 having the full liner 27 covering the entire foot 90 taken along line 16B-16B of FIG. 16A. Straps 50 and 52 are captured by the external half upper 21, with stitching 26 combining the two layers along both top and bottom edge of the straps in creating a sleeve like path of travel for the straps. This construction creates a double layered bottom sole upper 2 while the top portions remains a single layered thickness. Exposed external half upper 21 can differ in color and material with the full liner 27 to create an unique contrasting look for the upper design. The single top layer can provide better breathability, while the double bottom sole layers can provide additional cushioning for the wearer's foot. Variations of material used in the layers can also attribute to fit, support, insulation, cushioning and comfort of the footwear 1.

Figure 17A:
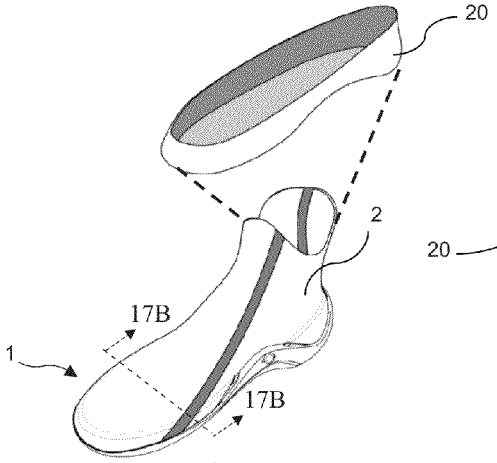
FIG. 17A shows an alternative method of inserting an internal half liner without slots to the bottom of the main upper layer with slots according to the present invention.
Figure 17B:
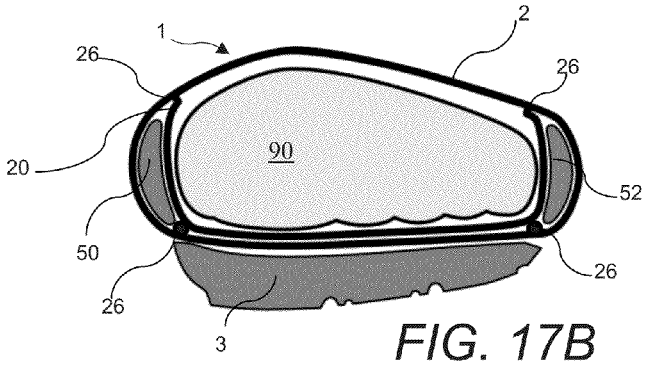
FIG. 17B shows a cross-sectional view of the assembled front, cross-section view through the forefoot region with straps captured between an internal half liners layer attached to the upper layer with slots.

FIG. 17A shows an assembled footwear 1 including an inner straps half liner 20, ready to be inserted into the upper 2 and FIG. 17B shows a cross-sectional view of an assembled forefoot section of footwear 1 having inner half liner 20 covering the straps 50 and 52, taken along line 17B-17B of FIG. 17A. The upper 2, with slots described above in FIG. 5-8, can be combined with the inner half liner 20 to insulate the wearer's foot from the straps now looped through the upper 2. The liner is attached by stitching 26 combining the two layers along both top and bottom edge of the straps in creating a sleeve like path of travel for the straps. This method of inserting an inner half liner 20 within the upper 2 hides the half liner 20 while providing double bottom sole layers with additional cushioning for the wearer's foot. Variations of material used in the layers can also attribute to fit, support, insulation, cushioning and comfort of the footwear.

Figure 18A:
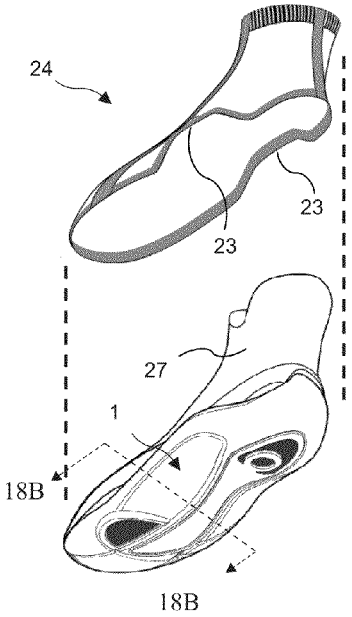
FIG. 18A shows a method of adding a second external upper layer to cover the straps without covering the bottom sole with a double layered construction according to the present invention.
Figure 18B:
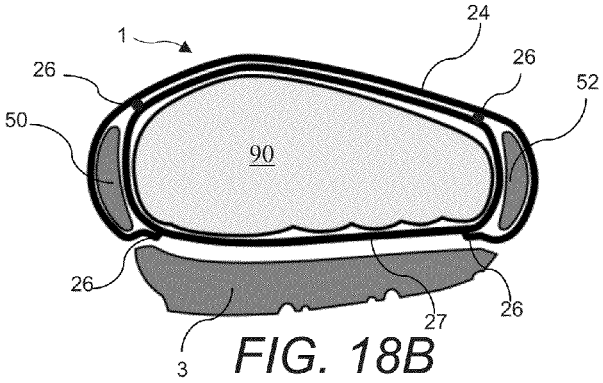
FIG. 18B shows the assembled front, cross-section view through the forefoot region with straps captured between an internal full upper layer attaching to the perimeters of the second external layer according to the present invention.

FIG. 18A shows a construction method for an upper using a full liner 27 and an outer overlapping layer 24 to eliminate needs of having slots in the upper 2 design and FIG. 18B shows a cross-sectional view of an assembled forefoot section of footwear 1 having an outer overlapping layer 24 covering the straps 50 and 52, taken along line 18B-18B of FIG. 18A. Outer layer 24 can cover the top portion of the foot 90 with an open bottom design ending just below the bottom perimeter path of the straps 50-53. The complete opened perimeter edge on the outer layer is reinforced to prevent tears and controlling a dimensionally stable edge. Corresponding to the arch wing location on both medial and lateral sides of the mid foot, a cutout zone 23 is incorporated into perimeter edge to allow straps to exit the outer overlapping layer. This method of attaching along the perimeter edge of an outer layer's 24 and the top path of straps 50-53 by stitching 26, creates a sleeve like path of travel for the straps. This eliminates needs to have reinforced slots in the upper 2 design. Single layer bottom sole also provide additional cooling for the foot 90.

Figure 18C:
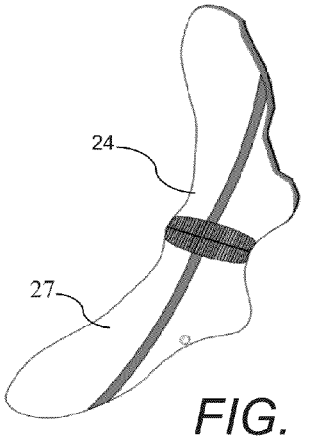
FIG. 18C shows a method of a secondary external upper layer jointed at the ankle end of the internal full upper in achieving a one piece construction able to fold over covering the straps without covering the bottom sole according to the present invention.

FIG. 18C shows an upper construction method of making both full liner 27 and outer overlapping layer 24 as one complete upper. The complete upper 2 can be described as the outer layer 24 and the full liner 27 connected at the base of the ankle. The complete upper 2 can also be described as one upper construction with extended height and a large reinforced opening. The outer layer 24 can be flipped down and folded over onto the inner full liner 27 then attaching along the perimeter edge of an outer layer 24 along the top path of straps 50-53 by stitching 26 creating a sleeve like path of travel for the straps. Ease of manufacturing and post production assembly can also be benefitted from this method of constructing the upper. Variations of material used in the layers can also attribute to fit, support, insulation, cushioning and comfort of the footwear.

Figure 19A:
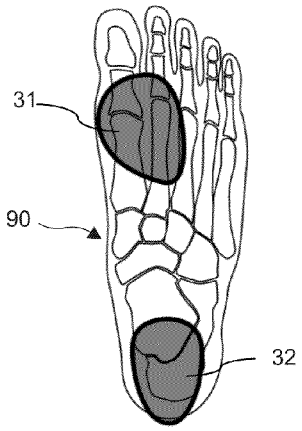
FIGS. 19A and 19B show the variations of individual cushioning zones needed in accordance to the bone structure pressure zones according to the present invention.

FIG. 19A illustrates the top view bone structure of the foot 90 with the fore foot (or ball of the foot) 31 and heel 32 cushioning zone. The forefoot 31 comprises a Sesamoid bone and tip of the first Metatarsal bone. The forefoot 31 serves as a weight distribution point of the fore foot and a push off point in a gait cycle. It is beneficial to provide localized cushioning and support with energy absorbing material for the forefoot zone 31 that is separate and unique from the rest of the foot.

Figure 19B:
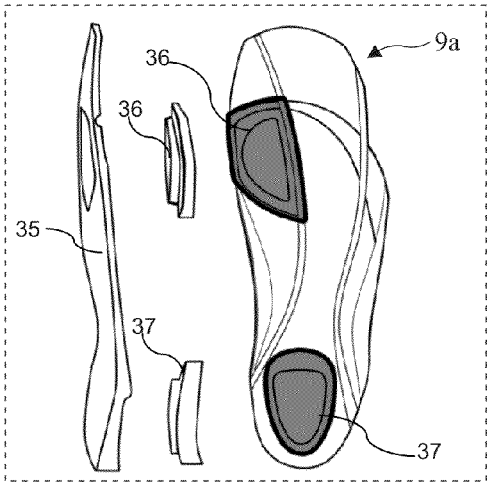

Another high weight distribution point is located at the Calcaneus bone which is commonly referred to as the heel 32 of the foot. The heel 32 also provides the initial landing or strike during a gait cycle as part of our bi-pedal movement. As the heel strikes the ground, it may be subject to the entire weight of our body in serving as a main load barring support for the foot. It is beneficial to provide localized cushioning and support with energy absorbing material for the heel zone 32 which is separate from the rest of the foot 90 which generally does not endure such load. FIG. 19B Illustrates how the forefoot 31 and heel zone 32 from FIG. 6A may be addressed by the mid sole 9 design. With through holes or cavities formed into a mid sole 9*a* to corresponding fore foot 31 and heel 32 zones from FIGS. 6A and 6B, mid sole 9 is able to accept a forefoot insert 36 and heel insert 37.

Figure 20A:
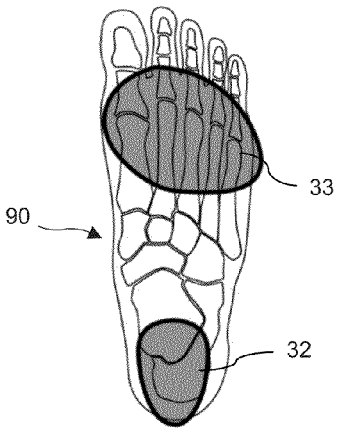
FIGS. 20A and 20B show the variations of individual cushioning zones needed in accordance to the bone structure pressure zones according to the present invention.
Figure 20B:
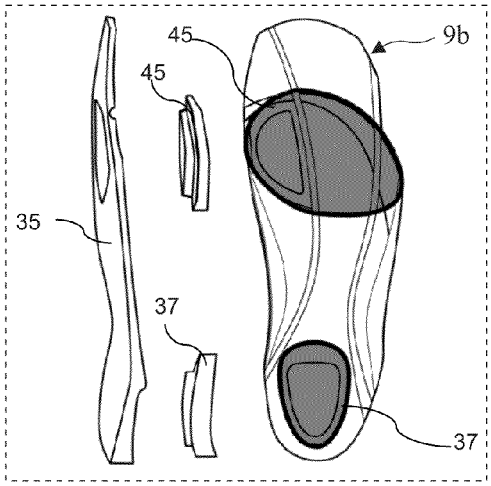

FIG. 20A shows an alternative embodiment of the present invention with an enlarged fore foot cushioning zone 33. The fore foot zone 33 may expand beyond the Sesamoid bone and tip of the first Metatarsal to include tips of all of the Metatarsal bones 90. FIG. 20B Illustrates how the fore foot 33 and heel zones 32 from FIG. 20A may be addressed in a mid sole 9*b* design. With through holes or cavities formed into the mid sole to corresponding fore foot zone 33 and heel zone 32 from FIG. 20A. Mid sole 9 is able to accept a larger fore foot insert 45 and heel insert 37. This layout provides the maximum cushioning and support for the fore foot.

Figure 21A:
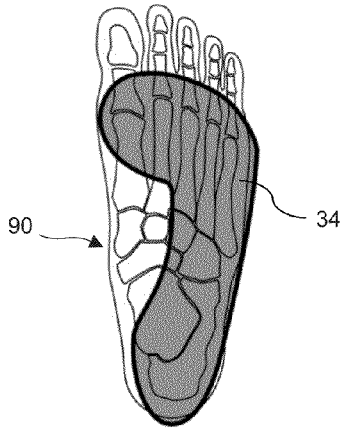
FIGS. 21A and 21B show the variations of individual cushioning zone needed in accordance to the bone structure pressure zones according to the present invention.
Figure 21B:
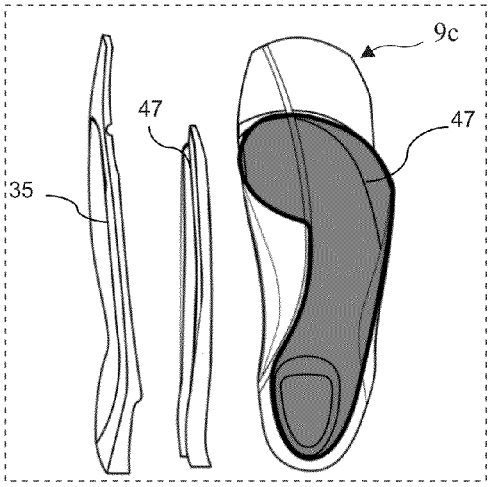

FIG. 21A shows an alternative embodiment of the present invention with an enlarged foot cushioning zone 34 to include fore foot with lateral side mid foot and heel zone. This enlarged zone represents all weight distributing area of the foot. FIG. 21B Illustrates how the enlarged cushioning zone from FIG. 21A may be addressed in a mid sole 9*c* design. With through hole or cavity formed into the mid sole to corresponding zone 34 from FIG. 21A, the mid sole 9 is able to accept a single larger foot insert 47 to provide maximum cushioning and support for the entire foot.

Figure 22A:
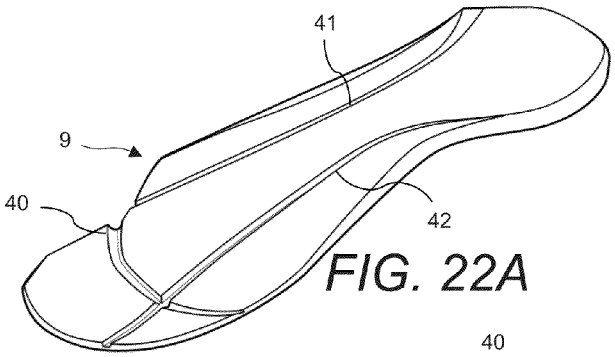
FIG. 22A is the top front three quarter view of a mid-sole design without individual cushioning zone inserts according to the present invention.
Figure 22B:
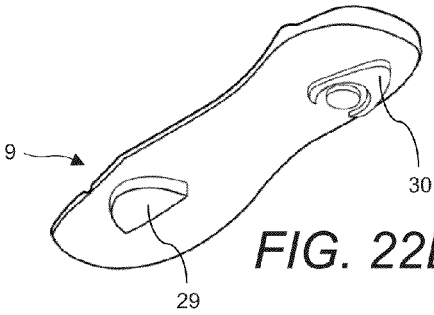
FIG. 22B is the bottom three quarter view of a mid-sole design with cushioning zones extended beneath the mid sole according to the present invention.

FIG. 22A show the elevated front three quarter view of the mid sole 9 formed into a single part without separate inserts and FIG. 22B is the bottom rear three quarter view of the mid sole 9 includes extended localized cushioning zones 29 and 30 shown in the forefoot and heel region. The mid sole 9 can be formed with a variety of polyurethane open or closed cell foam with resilient and energy absorbing characteristics. The main function of the mid sole 9 is to fully cushion and offer a level of support for the wearer's foot 90. Density of the mid sole 9 can vary depends upon the size of the footwear 1 as larger foot size generally corresponds to greater weight of the wearer. However, a range of Shore A durameter 10 to 40 can be using depending on the resiliency and rebounding properties of the material.

Figure 23:
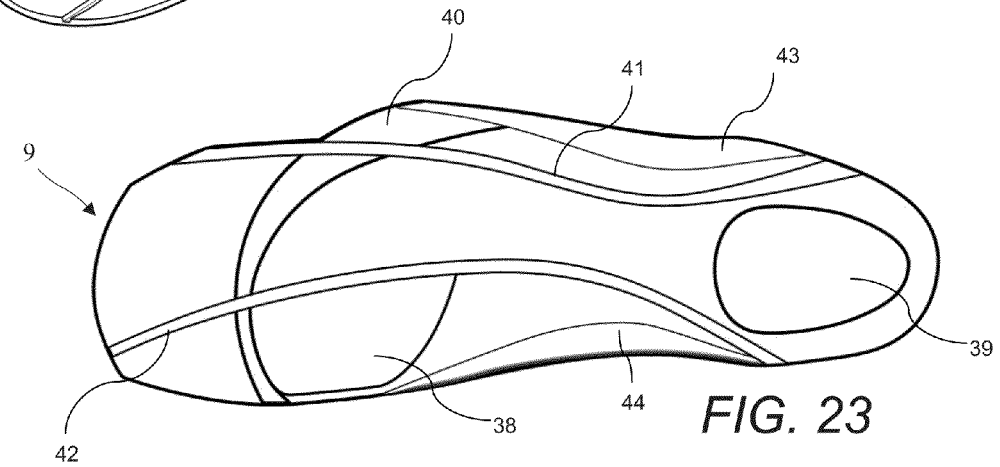
FIG. 23 shows the top plan view of the mid-sole design with detailed elements according to the present invention.

FIG. 23 illustrates the details of top view of the mid sole 9 design with locations of longitudinal lateral groove 41 and medial groove 42 shown along with the lateral forefoot groove 40. Recessed surfaces of the groove 40 at the forefoot region, following a lateral curved path where the metatarsals meets the phalanges. This enables the forefoot flexion in the push off stage of the gait cycle. The groove 40 can be narrow at the first metatarsals and spread wider across to the lateral side in promoting ease of forefoot flex and accommodating variation in individual's foot shape and flex location. Lateral groove 41 and medial groove 42 run longitudinal across the mid sole responsible for aiding pronatory flex of the foot. Lateral groove 41 and medial groove 42 may aid in the flexion of the arches as well as the first and fifth metatarsal joints. Lateral side arch slot 43 and medial side arch slot 44 are designed to provide pocketed area to receive the straps shown in FIGS. 11B and 30. The molded slot on the lateral 43 and medial 44 sides of the mid sole 9 allow the straps 50-52 to reside deeper into the sole base 4. This allows the inner strap surface to form a smooth transition with the mid sole 9 in following the mid foot contours of the foot 90. The grooves and channels also aid in ventilation efforts to keep the wearer's foot cool in every step. Formed through forefoot cavity 38 and heel cavity 39 are shown to accept corresponding inserts 36 and 37.

Figure 24A:
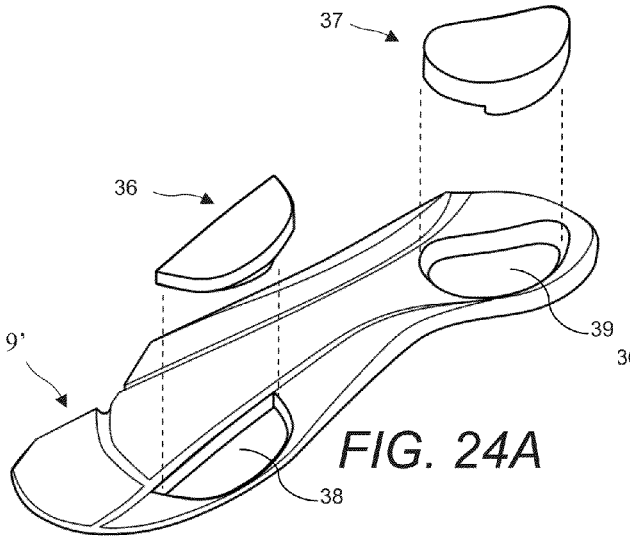
FIG. 24A is the top front three quarter view of a mid-sole design with individual cushioning zone inserts according to the present invention.
Figure 24B:
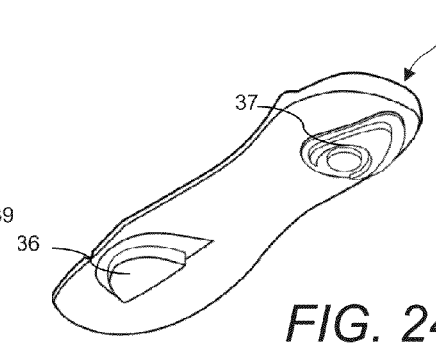
FIG. 24B is the bottom front three quarter view of a mid-sole design with individual cushioning zone inserts according to the present invention.

FIG. 24A is a perspective view of a mid sole 9' with forefoot cavity 38 ready to accept insert 36, and heel cavity 39 ready to accept heel insert 37. FIG. 24B show the bottom rear three quarter view of the mid sole 9' with inserts 36 and 37 and extended down with localized cushioning zones of the forefoot and heel region.

Figure 25A:
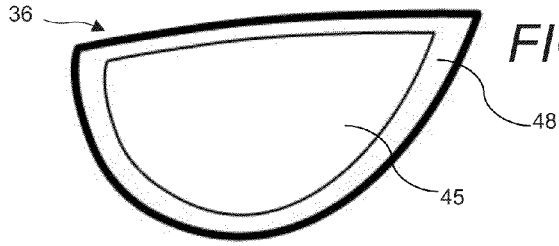
FIG. 25A shows the bottom view of the forefoot mid-sole inserts design in details according to the present invention according to the present invention.
Figure 25B:
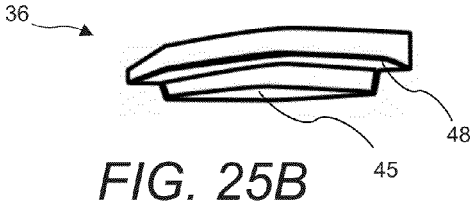
FIG. 25B shows the medial side view of the forefoot mid-sole inserts design in details according to the present invention.
Figure 25C:
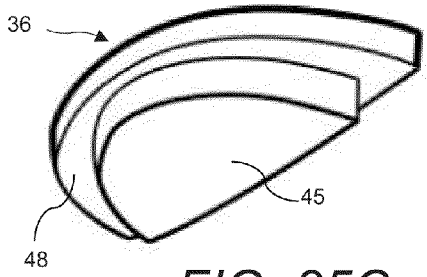
FIG. 25C is the bottom rear three quarter view of the forefoot insert.

Forefoot insert 36 is shown in FIGS. 25A-25C. The location of the inserts are described above in FIGS. 19A and 19B. FIG. 25A is a bottom view showing the smaller raised area of a second elevation 45 as the portion to be extended through formed in openings 65 of the sole base 4. FIG. 25B is the medial side view of the forefoot insert 36 showing the height of the raised second elevation 45. FIG. 25C is a bottom rear three quarter view of the fore foot insert 36. The raised area 45 offers additional compressible depth available to the wearer by maximizing the thickness of the insert through the bottom of sole base 4's thickness (also see FIG. 32) visible from the exterior of the sole assembly 3. The forefoot insert 36 may also be of different color, and texture designed to express branding and style in the overall presentation of the footwear 1.

Figure 26A:
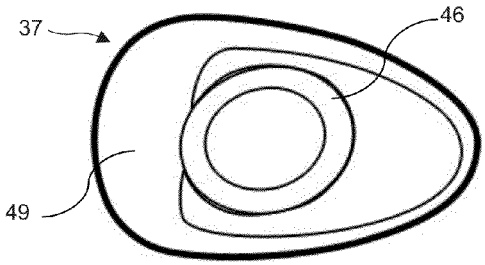
FIG. 26A shows the bottom view of the heel mid-sole inserts design in details according to the present invention according to the present invention.
Figure 26B:
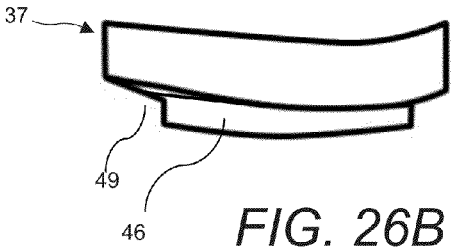
FIG. 26B shows the medial side view of the heel mid-sole inserts design in details according to the present invention.
Figure 26C:
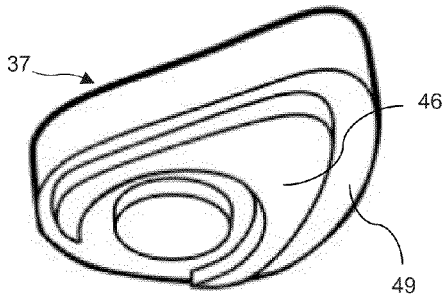
FIG. 26C shows the bottom three quarter view of the heel mid-sole inserts design in details according to the present invention.

Heel insert 37 is shown in FIG. 26A-26C. The location of the inserts are described above in FIGS. 19A and 19B. FIG. 26A is the bottom view showing the smaller raised area of an second elevation 46 as the portion extending through the formed in openings 66 in the sole base 4. FIG. 26B is the medial side view of the heel insert 37 showing the height of the raised second elevation 46. FIG. 26C is the bottom rear three quarter view of the heel insert 37. The raised area 46 offers additional compressible depth available to the wearer by maximizing the thickness of the insert through the bottom of sole base 4 thickness (also see FIG. 33), and is visible from the exterior of the sole assembly 3. The heel insert 37 may also be of different color, and texture designed to express branding and style in the overall presentation of the footwear 1.

The forefoot insert 36 resides in a location below a ball of the foot and on the inside half of the sole assembly 3 and is preferably between 20 to 80 mm long and between 10 and 50 mm wide. The heel insert 37 resides in a location below a heel of the foot and approximately centered laterally on the sole assembly 3, and is preferably between 15 and 80 mm long and between 15 and 50 mm wide.

Figure 27:
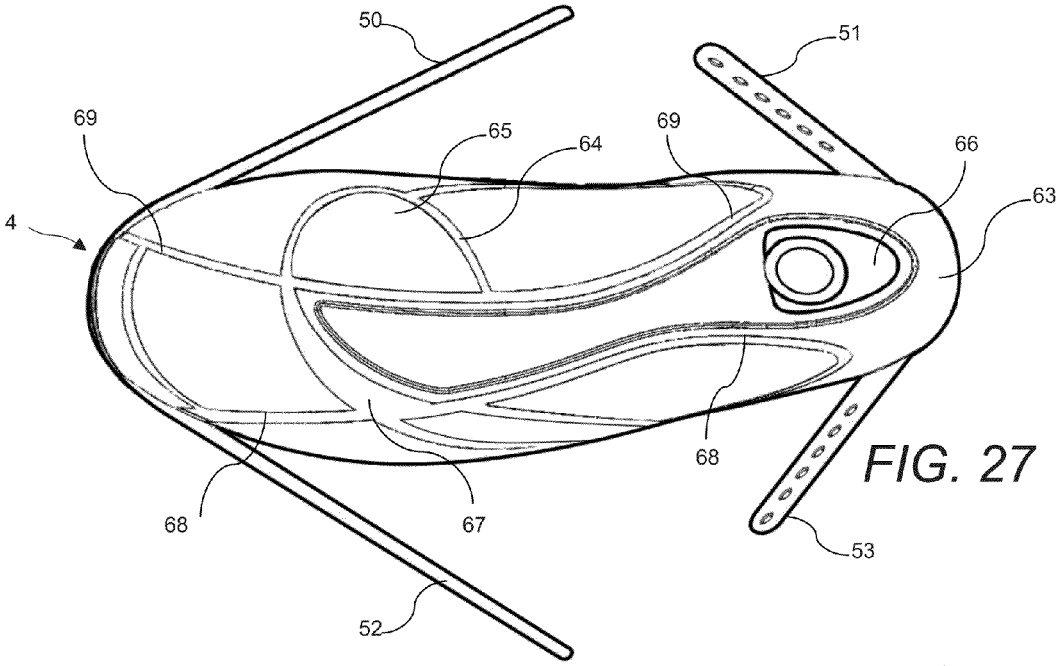
FIG. 27 is the detailed bottom plan view of the sole base design according to the present invention.
Figure 28:
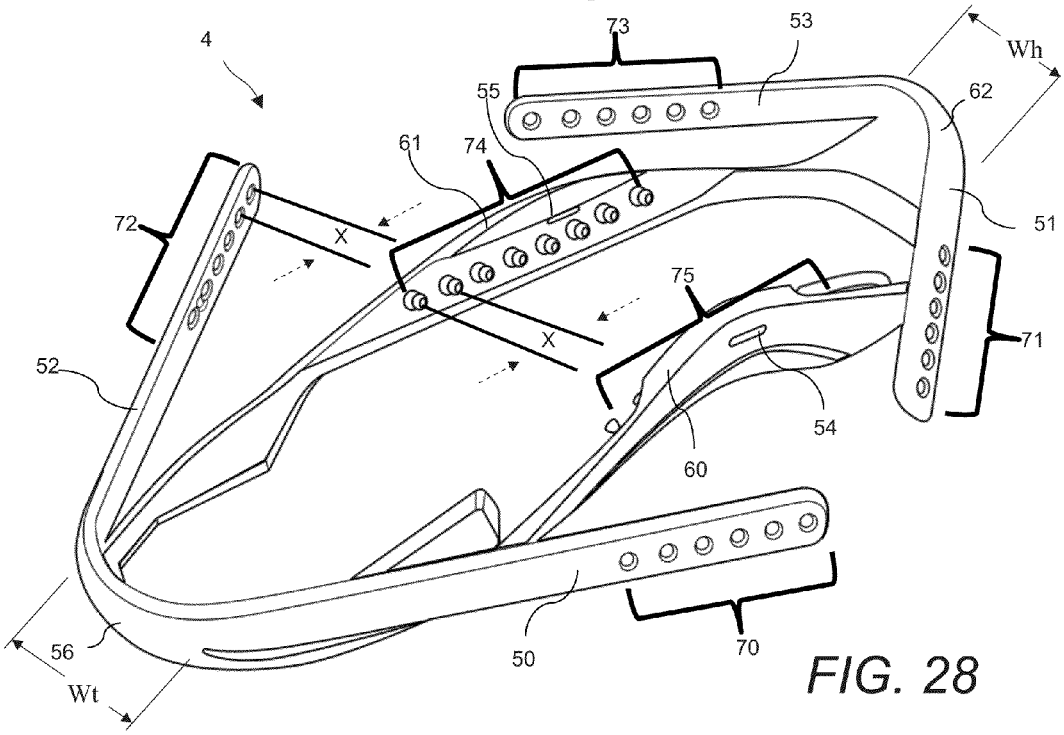
FIG. 28 shows the elevated front three quarter view of the sole base design in details according to the present invention.

FIG. 27 is a detailed bottom plan view of the sole base 4 showing straps 50-53 extending out, unattached to the arch wing studs 74 and 75 (see FIG. 28). Formed in forefoot insert hole 65 and heel hole 66 of the sole base 4 allow the inserts 36 and 37 to protrude there through. Curvatures and locations of the mid sole grooves 40, 41 and 42 overlay corresponding grooves 67, 68 and 69 of the sole base 4 to aid in flexion of the forefoot and mid foot region in unison with the mid sole 9. Molded in groove 67 starts on the medial side of the forefoot above the forefoot insert hole 65 as a narrow groove and spreads wider across to the lateral side to promote ease of forefoot flex and to accommodate variation in individual's foot shape and flex location. Groove 68 and medial groove 69 run longitudinal along the sole base 4 to aid pronatory flex of the mid foot while helping the sole assembly 3 to bend and flex in conforming around the foot 90. A raised edge 64 is molded around the forefoot insert hole 65 to aid in forefoot stability and supporting the perimeters of insert 36 (see FIG. 32). A flexible rounded sole heel 63 closely copies and surrounds the heel's contours, conforming around the Calcaneus and ending at the base of the Achilles tendon.

FIG. 28 is a detailed elevated front three quarter view of the sole base 4. A raised toe area 56 helps protect the toes while front straps 50 and 52 extend rearward from the raised toe area 56 on both sides moving rearward toward the medial and lateral arch wing 60 and 61. A raised heel area 62 helps protect the heel and Achilles area while rear straps 51 and 53 extend forward from the raised heel area 62 on both sides moving forward toward the medial and lateral arch wing 60 and 61. Button slots 54 and 55 are shown locating on the arch wings 60 and 61 for attachment with the corresponding buttons 17 and 18 of the upper 2. The locking mechanism layout of the sole base 4 is shown on the straps 50-53 each contain through holes 70-73. The through holes 70-73 cooperate with the studs 74 and 75 on the lateral arch wing 60 and medial arch wing 61. Each through hole 70-73 on the straps 50-53 may have equal center distance X with each proceeding hole. Each stud on the arch wing 74-75 is to have the same equal center distance X with each proceeding stud as to the through holes 70-73 on the straps 50-53. This arrangement allows the straps holes 70-73 to lock with the arch wing studs 74 and 75 in multiple positions to allow adjustability to the length of the straps. The straps 50-53 through holes 70-73 can vary in locking positions from front to back independently to adjust perimeter fit of the sole base 4. This feature can accommodate the foot 90 shape to fit in the forefoot and rear foot zones. Sole base 4 may be injection molded but may also be made from a cut and sewed construction 80 (see FIG. 34).

The front strap (comprising the straps 50 and 52) is joined to the sole base 4 at the raised toe area 56 across the sole front for a width Wt preferably between ten and 100 mm and the rear strap (comprising the straps 51 and 53) is joined to the sole base 4 at a raised heel area 62 across the sole rear for a width Wh preferably between ten and 80 mm.

Figure 29:
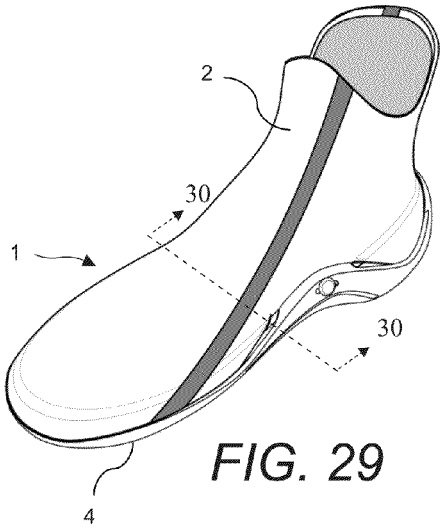
FIG. 29 shows the elevated front three quarter view of the assembled footwear according to the present invention.
Figure 30:
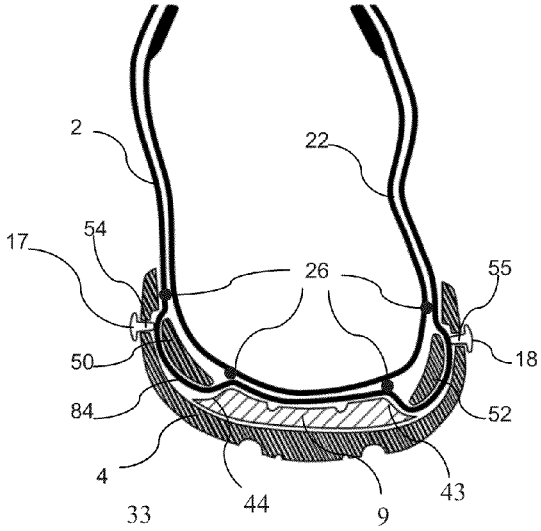
FIG. 30 shows a cross-sectional view of the assembled footwear with the cross section location through the mid foot region indicated taken along line 30-30 of FIG. 29, according to the present invention.

FIG. 29 Show the complete double layered upper 2 assembled to the sole 3 of footwear 1 and FIG. 30 shows a cross-section of the mid foot as the straps 50 and 52 is captured between upper 2 and the full inner liner 22 by stitching 26 attaching both layers together, taken along line 30-30 of FIG. 29. The upper 2 may be located on the sole assembly 3 by two single point attachments on opposite sides of the sole in the sole center region. The single point attachments are preferably buttons 17 and 18 attached through the arch wing's slots 54 and 55. The formed slot on the lateral side 43 and medial side 44 in the mid sole 9 provide pocketed area to receive the bottom portions of the straps 50-52. Thus allowing the inner strap surface to form a smooth transitional surface with the mid sole 9 in following the mid foot contours of the foot 90. A flush inner surface insulates the wearer's foot from any discomfort caused by uneven surfaces and differences in material hardness (see FIG. 11B).

Figure 31:
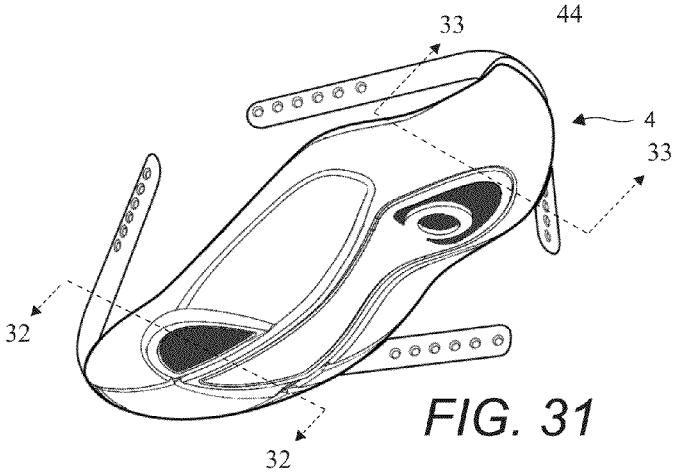
FIG. 31 shows the bottom, rear three quarter view of the assembled footwear according to the present invention.
Figure 32:
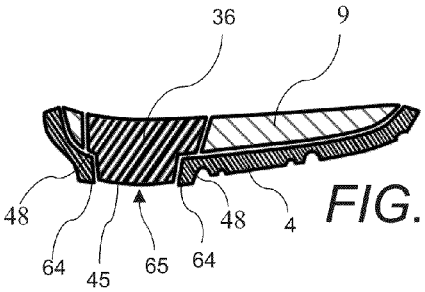
FIG. 32 shows a cross-sectional view of the assembled sole with the cross section's locations through the forefoot cushioning zone taken along line 32-32 of FIG. 31 according to the present invention.
Figure 33:
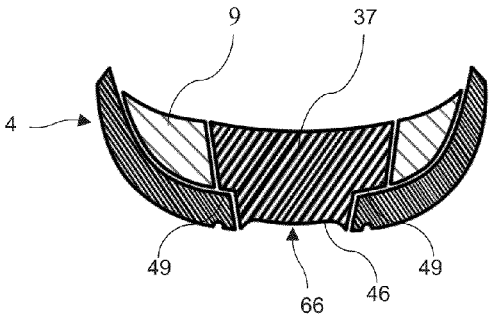
FIG. 33 shows a cross-sectional view of the assembled sole with the cross section's locations through the heel cushioning zone taken along line 33-33 of FIG. 31 according to the present invention.

FIG. 31 is a bottom rear three quarter view of the sole assembly 3, FIG. 32 is a cross-sectional view of the forefoot taken along line 32-32 of FIG. 31, and FIG. 33 is a cross-section view of the rear foot heel taken along line 33-33 of FIG. 31, The forefoot cross-section in FIG. 32 shows the thickness of sole base 4 and mid sole 9 in relation with the maximum thickness gained by using forefoot insert 36 through the entire sole assembly 3. A surface of a second elevation 45 is shown protruding through the opening 65 in the sole base 4 while the first surface 48 is being captured by the raised edge 64 of the sole base 4. The raised edge 64 is molded around the medial forefoot insert opening 65 to aid in forefoot stability and supporting the perimeters of insert 36. FIG. 33 shows the maximum thickness gained by the heel insert 37 extending through the entire thickness of the sole assembly. A surface of a second elevation 46 is shown protruding through the opening 66 of the sole base 4 while the first surface 49 is being captured by the sole base 4's. The sole base 4 can be seen as a ground engaging shell to carry the mid sole 9 and inserts 36 and 37.

Figure 34:
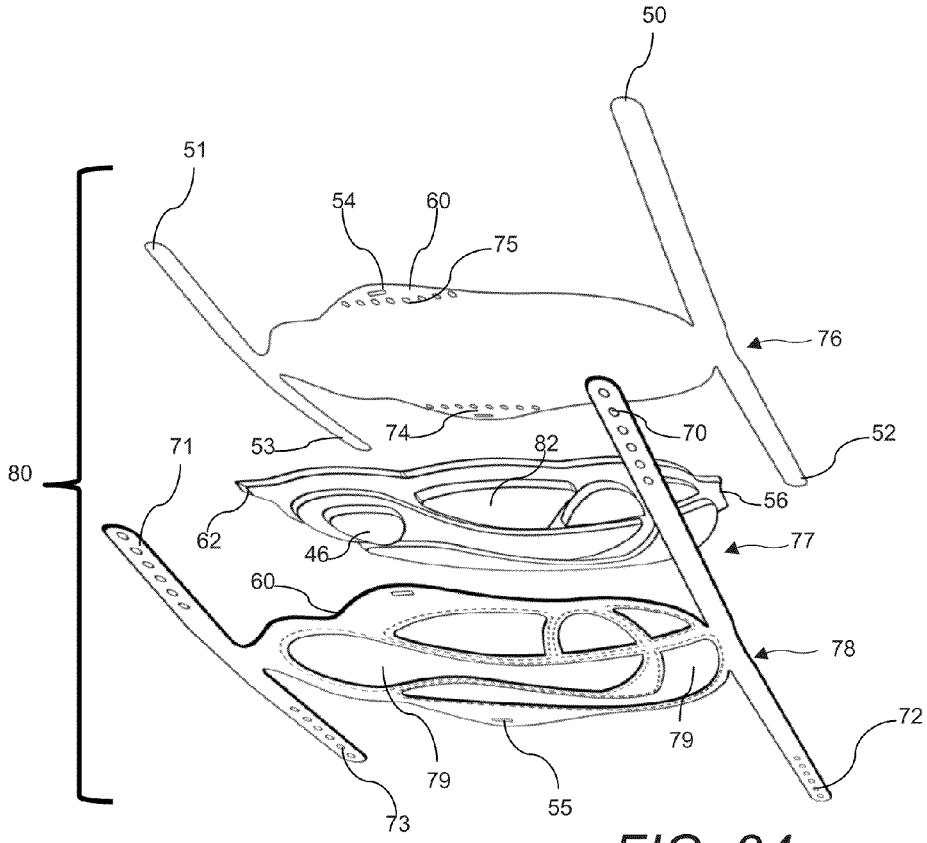
FIG. 34 is an exploded bottom three quarter view of an alternative multi piece sole construction method with a molded center mid-sole sandwiched between layers of inner and outer materials according to the present invention.

FIG. 34 is an exploded bottom perspective view of an alternative embodiment of the sole 80 of the present invention made with cut and sewed construction. The sole 80 is shown to be constructed from single or multiple layered cut materials in a pattern resembling a flattened version of the molded sole assembly 3 having features similar to the sole assembly 3. The sole assembly 80 is shown constructed from multiple cut, sheet material stacked and attached together. The sole 80 may have a top liner layer 76, a formed mid sole layer 77 sandwiched within the layers in providing cushioning and support, and an sole base 78 with openings in allowing the ground engaging features of the mid sole to extend though.

The liner layer 76 may have features similar to the sole base 4, for example, the straps 50-53, arch wings 60 and 61 and button hole 54 and 55, and attaching mechanism 74 and 75 on the arch wing. The liner layer 76 may be made from material to provide comfort against the foot 90. A top surface of the mid sole layer 77 may be a molded design copying contours of the foot 90, while the bottom may have surfaces of a second elevation forming pads 82 pushing through the sole 78 base to become a ground engaging surface of a driving sole design. Extended edges in the toe area 56 and heel area 62 are to protect the foot. The bottom sole base 78 may have features similar to the sole base 4. The features may include the straps 50-53, arch wings 60 and 61 and button hole 54 and 55. Attaching mechanism on the straps 70-73 is also represented. The sole base 78 may be made from many different types of material depending on performance needs of the wearer. The sole base 78 is preferably made from a denser material like leather to protect the foot. Cut through holes 79 may be included in the sole base 78 to allow pads 82 from the mid sole 77 to protrude through.

Figure 35:
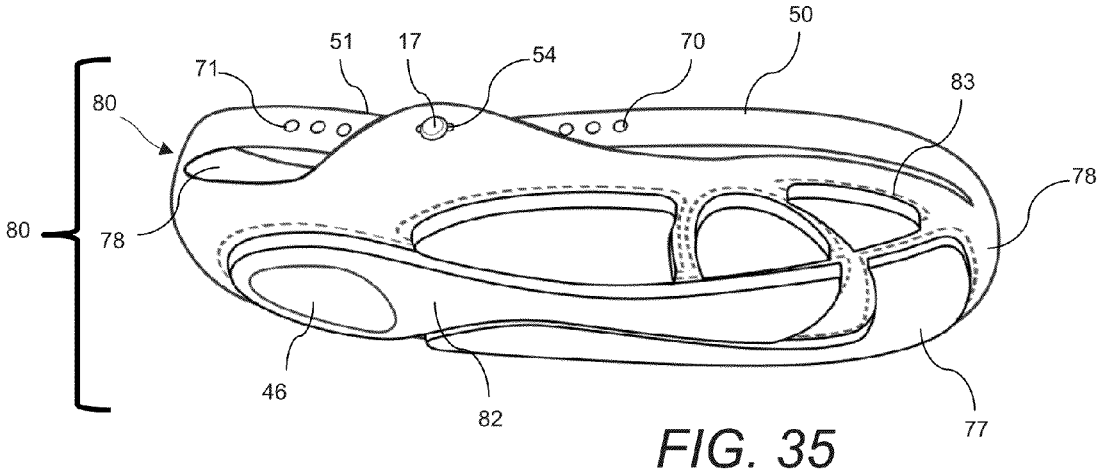
FIG. 35 is an assembled view of an alternative multi piece sole construction design according to the present invention.

FIG. 35 shows the complete assembled bottom perspective view of the alternative embodiment sole 80. Ground engaging pads 82 formed with surfaces of a second elevation are shown protruding through the cut openings of the sole base 78 creating a driving sole design. A molded in cavity 46 may represent brand logo on pads 82. Stitching 83 around the through holes opening of the sole base 78 is to bond and reinforce the opening. A separate ground engaging bottom sole surface can be formed with a second hardness unique from the mid sole in providing added support and structure for the wearer.

The combinations of all the components of the footwear 1 described above provide a new method for attachment and detachment the a footwear upper to a sole. The separability of the upper and sole enables a variety of customizable options to fit the wearer's needs. The method of placing straps along the outer perimeter edge in capturing the upper allows the top and bottom portions of the upper to stretch and expand with the foot freely and independently without binding, thus preserving the upper's ability of conforming to the wearer's complete foot shape without limitations set fourth by the straps or bonding of the upper to the sole. The straps purpose is to capture the upper without interfering with the upper's ability to expand and evenly distribute pressure throughout the foot. The features described above provide footwear addressing the problems of known footwear.

Characteristics, functions and advantages of the embodiment in the foregoing invention have been described in detail with drawings to reference the design. However the descriptions and drawings are only illustrative and do not limit the invention to these boundaries. Various combinations and changes to modify the invention may be possible by one skilled in the art without separating from the scope or spirit of the invention.

While the invention herein disclosed has been described by means of specific embodiments and applications thereof, numerous modifications and variations could be made thereto by those skilled in the art without departing from the scope of the invention set forth in the claims.

I claim:

1. An article of footwear (1) comprising:

a sole (3) having an outline of a foot, the sole defines a sole front, a sole center, and a sole rear;

four straps (50, 51, 52, 53) attached to the sole at opposite ends of the four straps, two straps (50, 52) attached to the sole at the sole front and attached to the sole near the sole center, and two straps (51,53) attached to the sole near the sole center and attached to the sole at the sole rear, the straps reaching around a portion of a perimeter of the sole, and the straps detachably attached to the sole at one end of each strap;

an upper (2) having the shape of the foot and open at the ankle; and slots (10, 11, 12, 14, 15, 16) in the upper (2) to allow the straps (50, 51, 52, 53) to enter and exit the upper (2), the engagement of the straps (50, 51, 52, 53) with the slots (10, 11, 12, 14, 15, 16) attaching the upper (2) to the sole (3).

2. The footwear (1) of claim 1, wherein said upper has sock like construction using stretchable materials to conform to shapes of the foot.

3. The footwear (1) of claim 1, wherein the locations of the slots in the upper are proximal to the attachment points of the straps to the sole.

4. The footwear (1) of claim 3, wherein the upper includes stitching around the slots to strengthen the slots.

5. The footwear (1) of claim 1, wherein:

the front straps include front fixed ends fixedly joined to the sole at the sole front and front detachable ends detachably attached to the sole near the sole center; and;

the rear straps include rear fixed ends fixedly joined to the sole at the sole rear and rear detachable ends detachably attached to the sole near the sole center.

6. The footwear (1) of claim 5, wherein the front and rear detachable ends are adjustably attachable to the sole near the sole center allowing adjustment of the straps to fit the foot.

7. The footwear (1) of claim 6, wherein the sole includes a plurality of longitudinally spaced apart studs along sides of the sole near the sole center, and the front and rear detachable ends of the straps include a plurality of longitudinally spaced apart holes having a same spacing as the studs for adjustable engagement with the studs.

8. The footwear (1) of claim 6, wherein:

the soles include a medial arch wing and a lateral arch wing raised on opposite sides of the sole center; and the straps are adjustably attached to the sole along the medial arch wing and the lateral arch wing.

9. The footwear (1) of claim 6, wherein:

the front strap is joined to the sole at a raised toe area (56) across the sole front for a width Wt between ten and 100 mm; and the rear strap is joined to the sole at a raised heel area (62) across the sole rear for a width Wh between ten and 80 mm.

10. The footwear (1) of claim 6, wherein the straps have a strap height Hs between five and 40 mm and a strap thickness Ts between two and fifteen mm.

11. The footwear (1) of claim 1, wherein the sole (3) comprises a sole base (4) forming an outline of the footwear (1) and a mid sole (9) resting on the sole base (4), the mid sole (9) made of a softer material than the sole base (4) to provide comfort to a wearer.

12. The footwear (1) of claim 11, wherein the mid sole (9) has the outline of the foot.

13. An article of footwear (1) comprising:

a sole (3) having an outline of a foot the sole comprising:

a sole base (4) forming an outline of the footwear (1); and mid sole (9) having the outline of a foot and resting on the sole base (4), the mid sole (9) made of a softer material than the sole base (4) to provide comfort to a wearer;

straps (50, 51, 52, 53) attached at opposite ends to the sole and reaching around a portion of a perimeter of the sole;

an upper (2) having the shape of the foot and open at the ankle; and slots (10, 11, 12, 14) in the upper (2) to allow the straps (50, 51, 52, 53) to enter and exit the upper (2), the straps (50, 51, 52, 53) attaching the upper (2) to the sole (3), wherein a forefoot insert (36) and a heel insert (37) reside in the heel and forefoot region of the footwear (1), the inserts (36, 37) extending through the bottom of the sole (3, 4) and contacting a ground surface.

14. The footwear (1) of claim 13, wherein the forefoot insert (36) resides in a location below a ball of the foot and on the inside half of the sole.

15. The footwear (1) of claim 14, wherein the forefoot insert (36) is between 20 to 80 mm long and between 10 and 50 mm wide.

16. The footwear (1) of claim 13, wherein the heel insert (37) resides in a location below a heel of the foot and approximately centered laterally on the sole.

17. The footwear (1) of claim 16, wherein the heel insert (37) is between 15 and 80 mm long and between 15 and 50 mm wide.

18. The footwear (1) of claim 13, wherein the forefoot insert (36) and the heel insert (37) are molded in parts of the mid sole (9) of a softer material that the rest of the mid sole (9).

19. The footwear (1) of claim 13, wherein the forefoot insert (36) and the heel insert (37) are inserted into the mid sole (9) of a softer material that the rest of the mid sole (9).

20. The footwear (1) of claim 1, wherein the upper is further located on the sole on opposite sides of the sole in the sole center region by two single point attachments.

21. An article of footwear (1) comprising:

a sole (3) having an outline of a foot;

straps (50, 51, 52, 53) attached at opposite ends to the sole and reaching around a portion of a perimeter of the sole;

an upper (2) having the shape of the foot and open at the ankle; and slots (10, 11, 12, 14) in the upper (2) to allow the straps (50, 51, 52, 53) to enter and exit the upper (2), the straps (50, 51, 52, 53) attaching the upper (2) to the sole (3), wherein the upper includes channels, the straps running through the channels to separate the straps from the foot.

22. The footwear (1) of claim 21, wherein the upper comprises an inner and an outer layer, the channels are formed between the inner and outer layers.

23. An article of footwear (1) comprising:

a sole (3) having an outline of a foot and defining a sole front, a sole center, and a sole rear, and including a medial arch wing and a lateral arch wing raised on opposite sides of the sole center;

straps (50, 51, 52, 53) reaching around a perimeter of the sole and comprising:

front straps (50, 52) including:

front fixed ends fixedly joined to the sole at the sole front; and front detachable ends adjustably detachably attached to the medial arch wing and the lateral arch wing on opposite sides of the sole; and rear straps (51 and 53) including:

rear fixed ends fixedly joined to the sole at the sole rear; and rear detachable ends adjustably detachably attached to the medial arch wing and the lateral arch wing on opposite sides of the sole;

an upper (2) having:

an upper toe end;

an upper heel end;

an upper center between the upper toe end and the upper heel end, a medial arch side of the upper center;

a lateral arch side of the upper center; and a sock like construction using stretchable materials to conform to shapes of the foot, the upper (2) open at the ankle; and slots in the upper (2), the slots comprising:

a toe slot (10) in the upper toe end;

a heel slot (14) in the upper heel end;

medial arch slots (11, 12) in the medial arch side of the upper center; and lateral arch slots (15, 16) in the lateral arch side of the upper center, the front straps (50, 52) entering the upper through the toe slot (10) and exiting the upper near the upper center through the medial arch slot (11) and the lateral arch slot (15), and the rear straps (51, 53) entering the upper through the heel slot (14) and exiting the upper near the upper center through the medial arch slot (12) and the lateral arch slot (16), the detachable ends of the straps exposed between the medial arch slots (11, 12) for attaching and adjusting the straps to the medial arch wing and exposed between the lateral arch slots (15, 16) for attaching and adjusting to the lateral arch wing for attaching the upper (2) to the sole (3).

24. An article of footwear (1) comprising:

a sole (3) having an outline of a foot and defining a sole front, a sole center, and a sole rear;

straps (50, 51, 52, 53) reaching around a perimeter of the sole and comprising:

front straps (50, 52) including:

first front strap ends attached to the sole at the sole front; and second front strap ends opposite the first front strap ends attached to opposite sides of the sole near the sole center, one of the first and the second front strap ends adjustably attached to the sole; and rear straps (51 and 53) including:

first rear strap ends attached to the sole at the sole rear; and second rear strap ends opposite the first rear strap ends attached to opposite sides of the sole, one of the first and the second rear strap ends adjustably attached to the sole;

an upper (2) having:

an upper toe end;

an upper heel end;

an upper center between the upper toe end and the upper heel end, a medial side of the upper center;

a lateral side of the upper center; and a sock like construction using stretchable materials to conform to shapes of the foot, the upper (2) open at the ankle; and slots in the upper (2), the slots comprising:

a toe slot (10) in the upper toe end;

a heel slot (14) in the upper heel end;

medial slots (11, 12) in the medial side of the upper center; and lateral slots (15, 16) in the lateral side of the upper center, the front straps (50, 52) entering the upper through the toe slot (10) and exiting the upper near the upper center through the medial slot (11) and the lateral slot (15), and the rear straps (51, 53) entering the upper through the heel slot (14) and exiting the upper near the upper center through the medial slot (12) and the lateral slot (16).

25. The footwear (1) of claim 1, wherein the straps (50, 51, 52, 53) are detachable from the sole (3) at only one end of each strap.

26. The footwear (1) of claim 1, wherein the straps (50, 51, 52, 53) are adjustably attached to the sole (3) at one end of each strap allowing adjustment of the straps to fit the foot.

27. The footwear (1) of claim 1, wherein the straps (50, 51, 52, 53) run generally horizontally through the upper (2).

28. The footwear (1) of claim 1, wherein:

two of the straps (50, 51, 52, 53) enter the upper through slots proximal to the sole front and continue inside the upper to slots proximal to the sole center, exiting the upper proximal to the sole center; and two of the straps (50, 51, 52, 53) enter the upper through slots proximal to the sole rear and continue inside the upper to slots proximal to the sole center, exiting the upper proximal to the sole center.

* * * * *